US008109179B2

(12) United States Patent
Richardson

(10) Patent No.: US 8,109,179 B2
(45) Date of Patent: Feb. 7, 2012

(54) POWER TONG

(76) Inventor: Allan Stewart Richardson, The Woodlands, TX (US)

( * ) Notice: Subject to any disclaimer, the term of this patent is extended or adjusted under 35 U.S.C. 154(b) by 32 days.

(21) Appl. No.: 12/379,090

(22) Filed: Feb. 12, 2009

(65) Prior Publication Data

US 2010/0199812 A1 Aug. 12, 2010

Related U.S. Application Data

(60) Provisional application No. 61/064,032, filed on Feb. 12, 2008, provisional application No. 61/071,170, filed on Apr. 16, 2008.

(51) Int. Cl.
*B25B 13/50* (2006.01)
*E21B 19/16* (2006.01)

(52) U.S. Cl. ..... 81/57.11; 81/16; 81/22; 81/24

(58) Field of Classification Search ..... 81/57.11, 81/57.16, 57.22, 57.24, 57.34, 57.35
See application file for complete search history.

(56) References Cited

U.S. PATENT DOCUMENTS 4,194,419 A * 3/1980 Mitchhart et al. ..... 81/57.35
4,979,356 A * 12/1990 Vatne ..... 81/57.16
5,167,173 A 12/1992 Pietras
6,082,225 A * 7/2000 Richardson ..... 81/57.16
6,752,044 B2 * 6/2004 Hawkins, III ..... 81/57.34
6,776,070 B1 8/2004 Mason et al.
7,000,502 B2 * 2/2006 Belik ..... 81/57.16
7,313,986 B2 * 1/2008 West et al. ..... 81/57.16
7,437,974 B2 * 10/2008 Slettedal et al. ..... 81/57.34
2008/0282847 A1 * 11/2008 Halse ..... 81/57.15
2009/0211404 A1 * 8/2009 Pedersen et al. ..... 81/57.16
2009/0314137 A1 * 12/2009 Perez ..... 81/57.16

* cited by examiner

*Primary Examiner* — Hadi Shakeri
(74) *Attorney, Agent, or Firm* — Anthony C. Edwards

(57) ABSTRACT

A power tong continuously rotates tubulars for spinning and torquing threaded connections. Continuous rotation is achieved through a rotating jaw having grippers that grip the tubular and continuously rotate with it. Hydraulic and electrical power necessary for actuating the grippers is generated on board. A serpentine belt system turns the motors of the on-board hydraulic power unit and electric generators to supply the grippers with hydraulic and electrical power. The serpentine belt system is driven by a secondary drive mounted on a fixed frame. The rotating jaw is rotatably mounted to the fixed frame and driven during continuous three hundred and sixty degrees of rotation by a primary drive, mounted on the fixed frame. A fixed jaw is also mounted to the frame. Tubular grippers on the fixed jaw grip a first side of a tubular joint. The grippers on the rotating jaw grip the opposite second side of the tubular joint. High torque low-rotational speed applied to the rotating jaw torques the joint. Low torque high-rotational speed applied to the rotating jaw spins the joint.

19 Claims, 22 Drawing Sheets

PARKED POSITION

POWER TONG

CROSS REFERENCE TO RELATED APPLICATION

This application claims priority from U.S. Provisional Patent Application No. 61/064,032 filed Feb. 12, 2008 entitled Power Tong, and U.S. Provisional Patent Application No. 61/071,170 filed Apr. 16, 2008 entitled Power Tong.

FIELD OF THE INVENTION

This invention relates to the field of devices for rotating tubular members so as to make up or break out threaded joints between tubulars including casing, drill pipe, drill collars and tubing (herein referred to collectively as pipe or tubulars), and in particular to a power tong for the improved handling and efficient automation of such activity.

BACKGROUND OF THE INVENTION

In applicant's experience, on conventional rotary rigs, helpers, otherwise known as roughnecks, handle the lower end of the pipe when they are tripping it in or out of the hole. They also use large wrenches commonly referred to as tongs to screw or unscrew, that is make up or break out pipe. Applicant is aware that there are some other tongs that are so called power tongs, torque wrenches, or iron roughnecks which replace the conventional tongs. The use of prior art conventional tongs is illustrated in FIG. 1*a*. Other tongs are described in the following prior art descriptions.

In the prior art applicant is aware of U.S. Pat. No. 6,082,225 which issued Feb. 17, 1997 to Richardson for a Power Tong Wrench. Richardson describes an power tong wrench having an open slot to accommodate a range of pipe diameters capable of making and breaking pipe threads and spinning in or out the threads and in which hydraulic power is supplied with a pump disposed within a rotary assembly. The pump is powered through a non-mechanical coupling, taught to a motor disposed outside the rotary assembly.

In the present invention the rotary hydraulic and electrical systems are powered at all times and in all rotary positions via a serpentine belt drive, unlike in the Richardson patent in which they are powered only in the home position. In the present invention the pipe can thus be gripped and ungripped repeatedly in any rotary position with no dependence on stored energy and the tong according to the present invention may be more compact because of reduced hydraulic accumulator requirements for energy storage wherein hydraulic accumulators are used for energy storage only to enhance gripping speed.

Applicant is also aware of U.S. Pat. No. 5,167,173 which issued Dec. 1, 1992 to Pietras for a Tong. Pietras describes that tongs are used in the drilling industry for gripping and rotating pipes, Pietras stating that generally pipes are gripped between one or more passive jaws and one or more active jaws which are urged against the pipe. He states that normally the radial position of the jaws is fixed and consequently these jaws and/or their jaw holders must be changed to accommodate pipes of different diameters.

Applicant is also aware of U.S. Pat. No. 6,776,070 which issued Aug. 17, 2004 to Mason et al. for an Iron Roughneck. Mason et al. describes an iron roughneck as including a pair of upper jaws carrying pipe gripping dies for gripping tool joints where the jaws have recesses formed on each side of the pipe gripping dies to receive spinning rollers. By positioning the spinning rollers in the upper jaws at the same level as the pipe gripping dies the spinning rollers are able to engage the pipe closer to the lower jaws and thus can act on the tool joint rather than on the pipe stem. Mason et al. describe that in running a string of drill pipe or other pipe into or out of a well, a combination torque wrench and spinning wrench are often used, referred to as "iron roughnecks". These devices combine torque and spinning wrenches as for example described in U.S. Pat. Nos. 4,023,449, 4,348,920, and 4,765,401, to Boyadjieff.

In the prior art iron roughnecks, spinning wrenches and torque wrenches are commonly mounted together on a single carriage but are, nevertheless, separate machines with the exception of the Iron Roughnecks of Mason which combines the spinner wrench rollers and torque jaws in a common holder, although they nevertheless, still work independently of each other. When breaking-out, or loosening, connections between two joints of drill pipe, the upper jaw of the torque wrench is used to clamp onto the end portion of an upper joint of pipe, and the lower jaw of the torque wrench clamps onto the end portion of the lower joint of pipe.

Drill pipe manufacturers add threaded components, called "tool joints", to each end of a joint of drill pipe. They add the threaded tool joints because the metal wall of drill pipe is not thick enough for threads to be cut into them. The tool joints are welded over the end portions of the drill pipe and give the pipe a characteristic bulge at each end. One tool joint, having female, or inside threads, is called a "box". The tool joint on the other end has male, or outside threads, and is called the "pin". Disconnection of the pin from the box requires both a high-torque and low angular displacement 'break' action to disengage the contact shoulders and a low-torque high-angular displacement 'spin' action to screw out the threads. Connection of the pin and box require the reverse sequence. In the make/break action torque is high (10,000-100,000 ft-lb), having a small (30-60 degrees) angular displacement. In the spin action torque is low (1,000-3,000 ft-lb), having a large (3-5 revolutions) angular displacement.

After clamping onto the tool joints, the upper and lower jaws are turned relative to each other to break the connection between the upper and lower tool joints. The upper jaw is then released while the lower jaw (back-up) remains clamped onto the lower tool joint. A spinning wrench, which is commonly separate from the torque wrench and mounted higher up on the carriage, engages the stem of the upper joint of drill pipe and spins the upper joint of drill pipe until it is disconnected from the lower joint. When making up (connecting) two joints of pipe the lower jaw (back-up) grips the lower tool joint, the upper pipe is brought into position, the spinning wrench (or in some cases a top drive) engages the upper joint and spins it in. The torque wrench upper jaws clamp the pipe and tightens the connection.

Applicant is further aware of United States Published patent application entitled Power Tong, which was published Apr. 5, 2007 under Publication No. US 2007/0074606 for the application of Halse. Halse discloses a power tong which includes a drive ring and at least one clamping device with the clamping devices arranged to grip a pipe string. A driving mechanism is provided for rotation of the clamping device about the longitudinal axis of the pipe string. The clamping device communicates with a fluid supply via a swivel ring that encircles the drive ring of the driving mechanism. Thus Halse provides for three hundred sixty degree continuous rotation combining a spinner with a torque tong. The Halse power tong does not include a radial opening, the tong having a swivel coupling surrounding the tong for transferring pressurized fluid from an external source to the tong when the tong rotates about the axis of the pipe. Halse states that having a radial opening in a power tong complicates the design of the power tong and weakens the structure surrounding the pipe considerably, stating that as a result, the structure must be up-rated in order to accommodate the relatively large forces being transferred between the power tong and the pipe string. Halse further opines that a relatively complicated mechanical device is required to close the radial opening when the power tong is in use, and in many cases also to transfer forces between the sides of the opening. The Halse tong is not desirable for drilling operations because there is no throat opening to allow the tong to be positioned around the pipe at the operator's discretion. The pipe must always pass through the tong.

SUMMARY OF THE INVENTION

The power tong according to the present invention continuously rotates tubulars for spinning and torquing threaded connections. Continuous rotation is achieved through a rotating jaw that has grippers that grip the tubular. Hydraulic and electrical power necessary for actuating the grippers is generated on board the rotating jaw since the continuous rotation does not allow for either hydraulic or electrical external connections. A serpentine drive belt system turns the motors of an on-board hydraulic power unit and electric generators to supply the grippers with the necessary hydraulic and electrical power.

The present invention includes a main drive, rotary jaw and back-up jaw. The rotary jaw is supported and held in position by the use of opposed helical pinions/gears which support the rotary jaw vertically and guide bushings which locate it laterally. The rotary jaw hydraulic gripper cylinders are held in position by links and guide bushings that can withstand the torque parameters of the tong. Gripper cylinders can be moved in a range of travel by an eccentric. This provides for a tong that can accommodate a large range of pipe diameters (3.5 inch drillpipe to 9⅝ inch casing or larger). This large range can be accomplished without changing gripping jaws or jaw holders. A centralizing linkage ensures that the pipe is gripped concentrically with the tong axis of rotation. The tong does not require a mechanical device to close the radial opening. The on-board power source and rotary control system allow the present invention to have fully independently activated and controlled rotary hydraulic gripping of the tubular. It is capable of high torque for making and breaking and high speed for spinning, all within one mechanism. The present invention also overcomes the limitation of the spinning wrench engaging the stem area of the drillpipe which over time will cause fatigue in the stem area as the spinning and torquing according to the present invention is accomplished with the same jaw that engages the pipe on the tool joint. The open throat of the jaws according to the present invention allows the power tong to be selectively positioned around the pipe at the operators' discretion.

DETAILED DESCRIPTION OF EMBODIMENTS OF THE INVENTION

Figure 1:
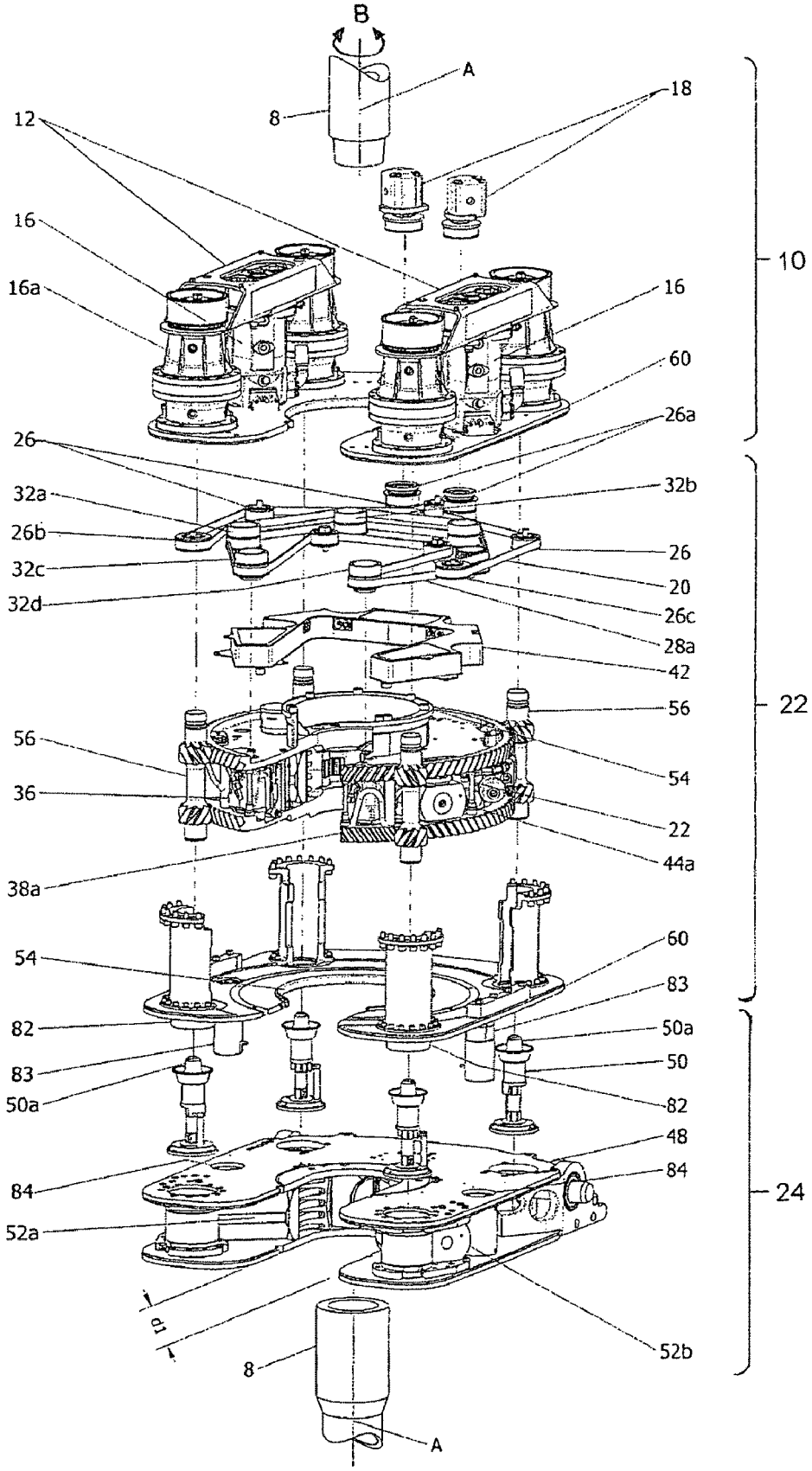
FIG. 1 is, in exploded perspective view, the power tong according to one embodiment of the present invention.
Figure 1A:
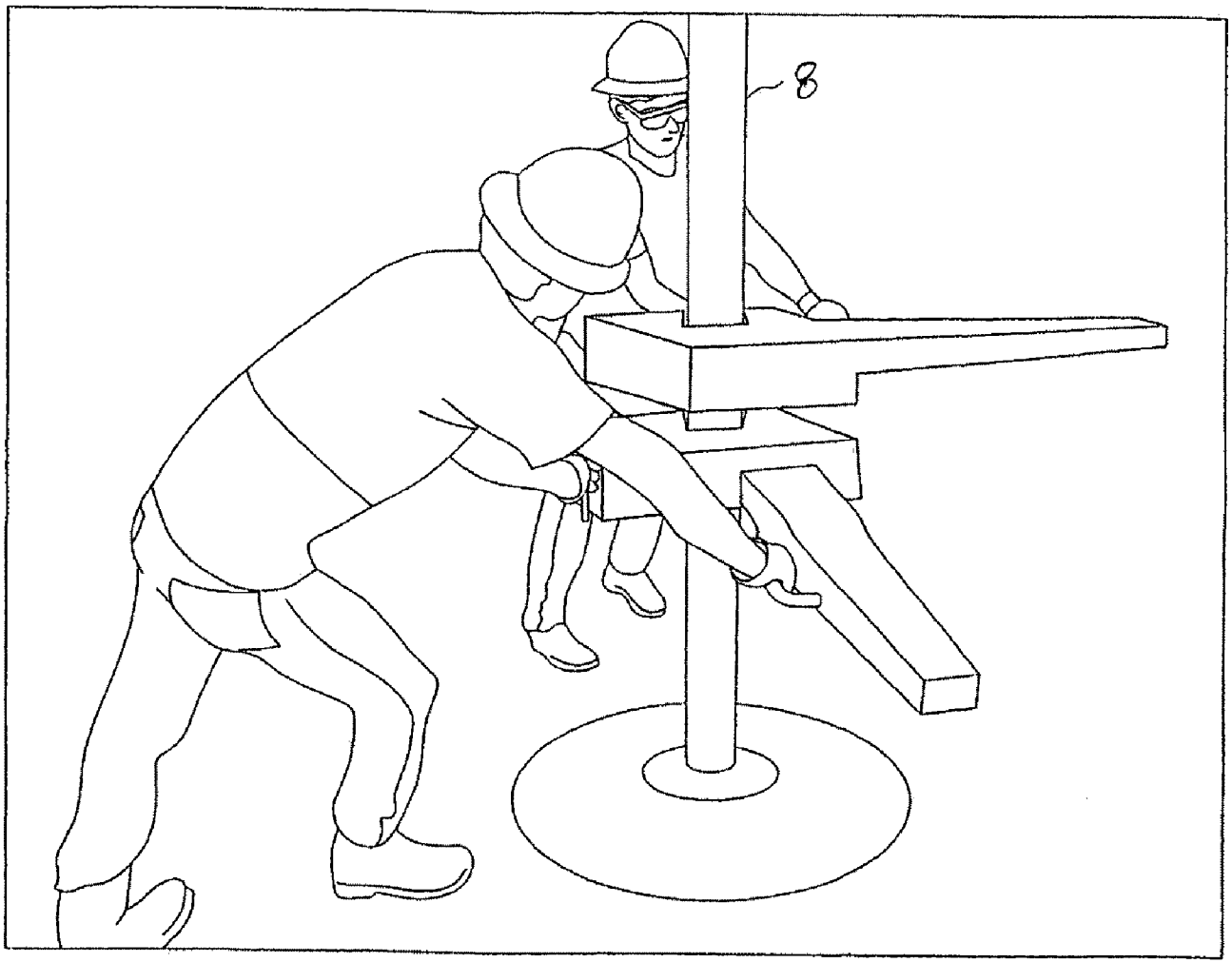
FIG. 1a PRIOR ART
FIG. 1*a* is a depiction of the use of prior art conventional tongs.
Figure 1B:
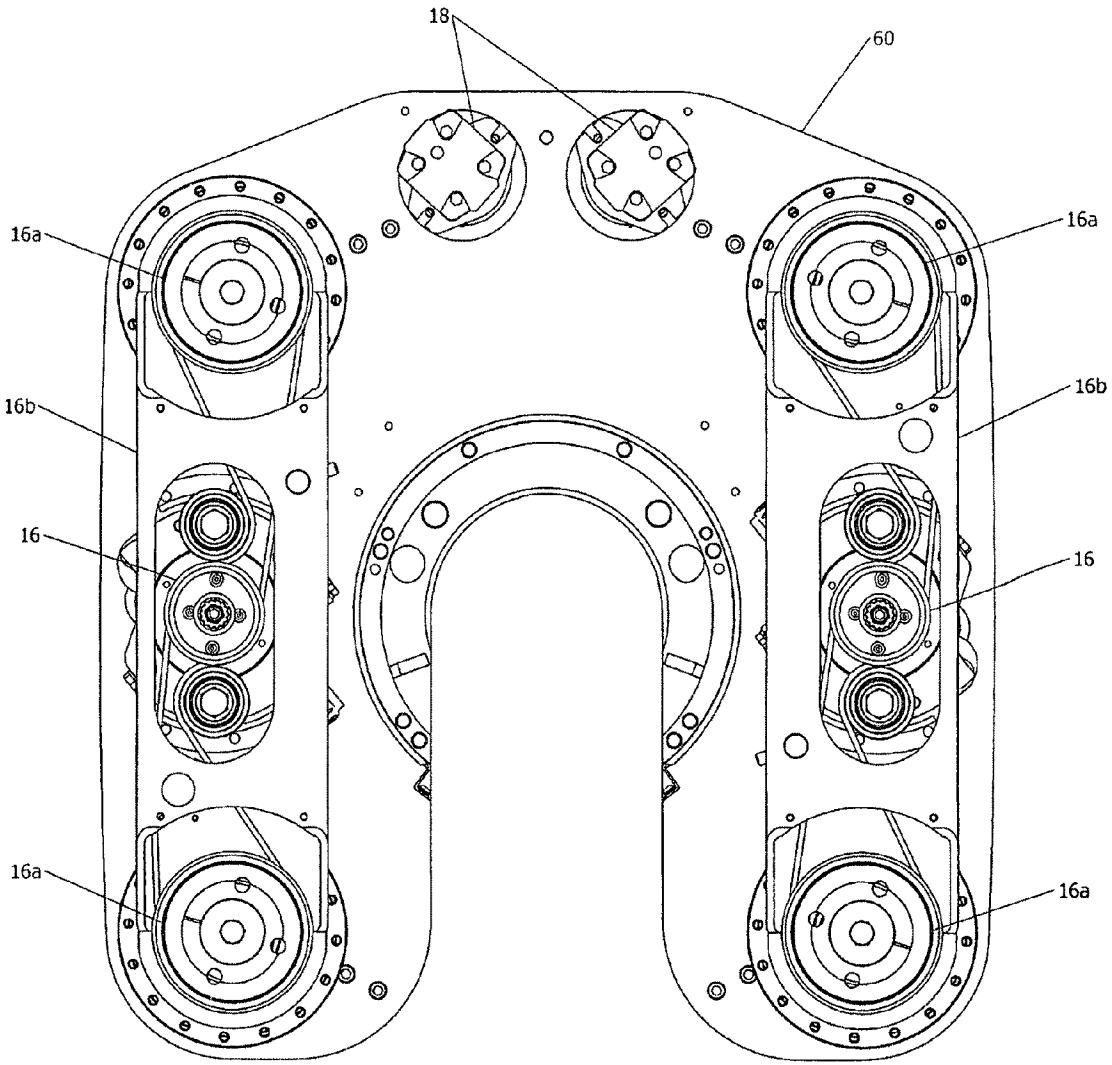
FIG. 1*b* is a top view of the drive section of the power tong of FIG. 1.
Figure 2:
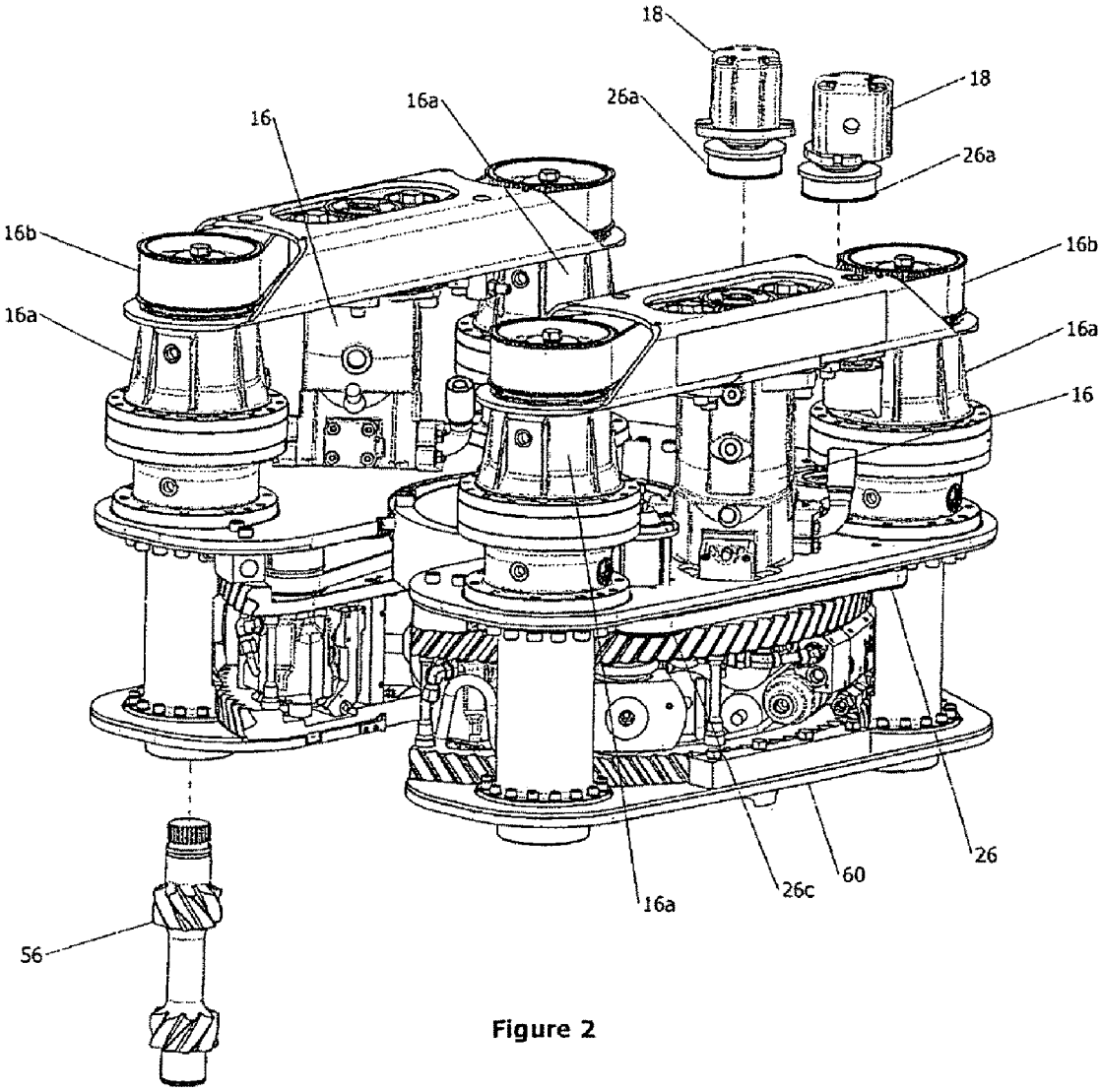
FIG. 2 is a perspective view of the main and rotary drive of the power tong of FIG. 1.

As seen in FIGS. 1 and 2, the power tong 6 according to the present invention may be characterized in one aspect as including three main sections mounted on a common axis A; namely a main drive section, a rotary jaw, and back-up jaw. Each of the sections contains actuators, as better described below. The main drive section 10 is located about the rotary jaw 22 and the backup jaw 48. The rotary jaw rotates relative to the main drive and back-up jaw. Both the rotary jaw and backup jaw clamp their respective sections of pipe. The rotary jaw is rotated by the main drive section independently of the other two sections in the sense that the rotary jaw is self-contained, having on-board hydraulic and electric power generators to power on-board radial clamps or grippers (collectively herein referred to as grippers), and an on-board serpentine secondary power transmission all configured to allow the insertion and removal of a pipe through a jaw opening from or into the center of the jaw, so that the pipe, when in the center of the jaw may be clamped, torqued, and spun about axis A of rotation of the rotary jaw while the other, oppositely disposed section of pipe is held clamped in the center of the back-up jaw.

With the reference to the drawings figures which are not intending to be limiting and wherein like characters of reference denote corresponding parts in each view, the uppermost section is the main drive section 10. Main drive section 10 includes primary drives 12, each of which includes rotary drive hydraulic motors 16, gear reduction devices 16*a*, and belt drives 16*b* as better seen in FIG. 2. Motors 16 cooperate with drive pinions 56 to rotate rotary jaw section 22 relative to main drive section 10 and back-up jaw section 24.

Figure 3:
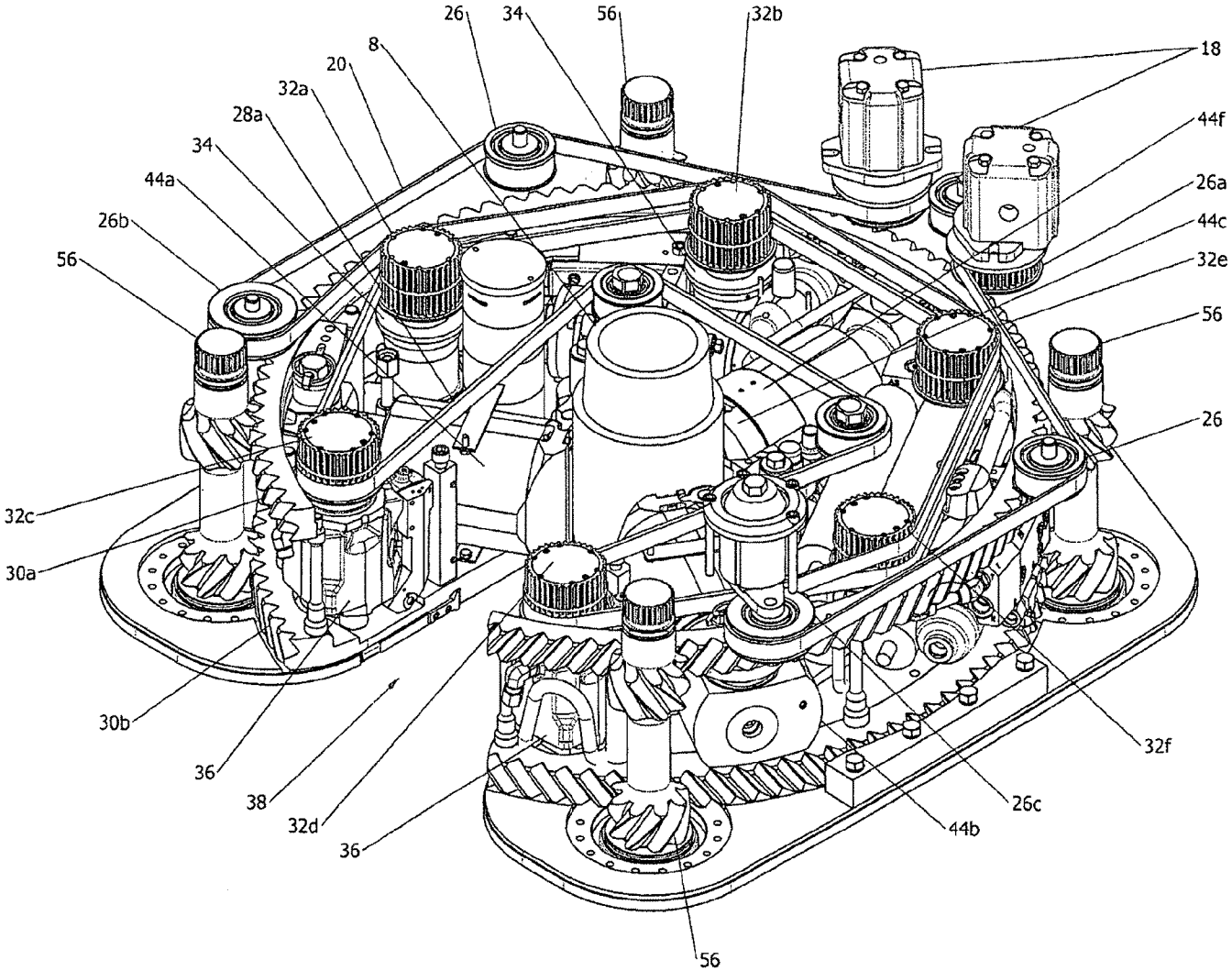
FIG. 3 is, in partially cut away perspective view, the rotary drive section and serpentine drive belt of the power tong of FIG. 1.

As shown in FIGS. 1, 2 and 3 rotary jaw section 22 is housed within drive section 10. The rotary jaw 22 is cylindrical in shape and has an opening slot having a throat 38 allowing the tong axis of rotation A to be selectively positioned concentric with pipe 8, provided the rotary jaw 22 is rotated such that its throat 38 is aligned with the front openings 28 and 29 of the main drive section and back-up jaw, respectively. Center 40 of the yoke formed by the jaw and slot corresponds with axis A. The rotary jaw section 22 has three gripper actuators 44*a*, 44*b*, and 44*c* arranged radially, with approximately equal angular spacing around axis A, mounted between the two parallel horizontal planes containing rotary jaw gears 30*a* and 30*b*.

Figure 4:
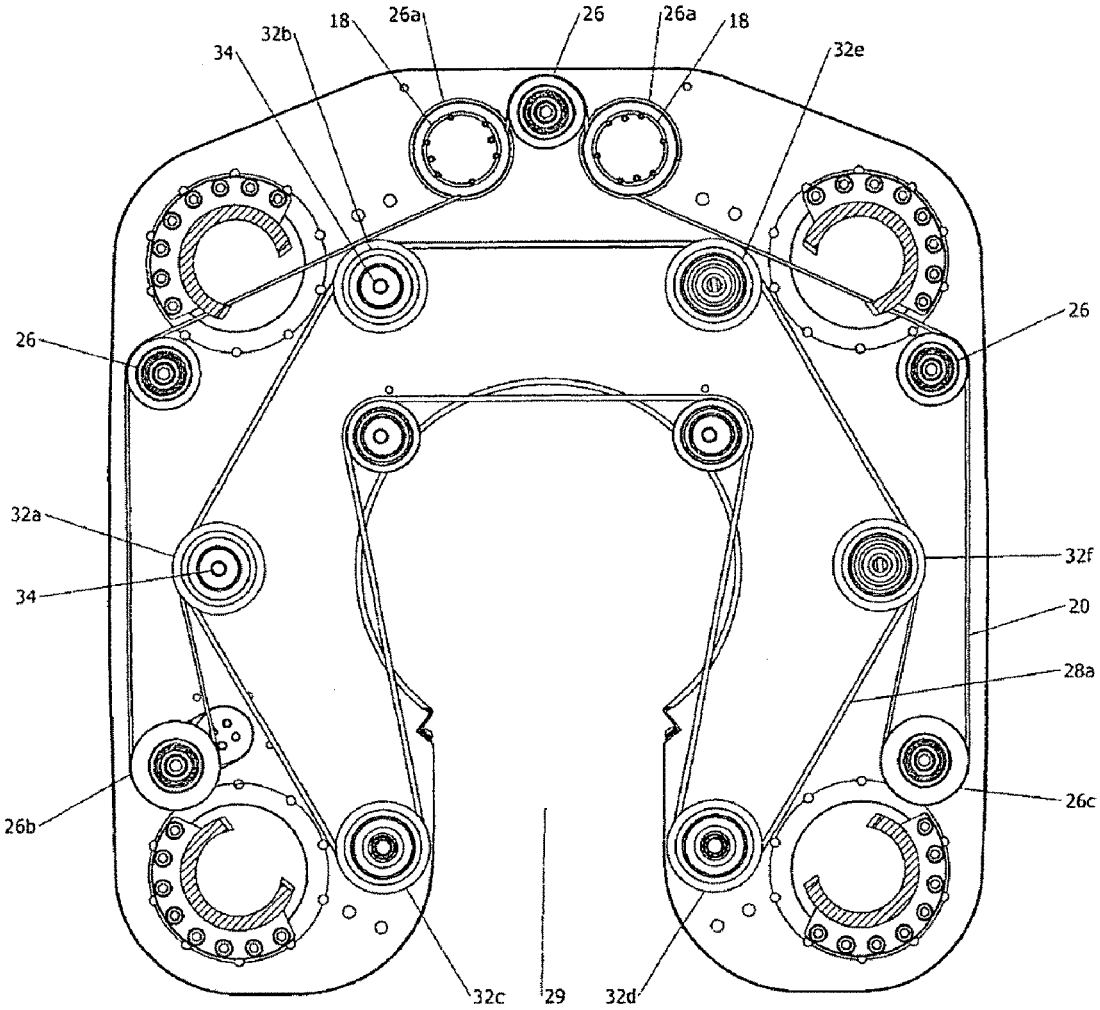
FIG. 4 is a plan view of the serpentine and synchronization belt drive system of FIG. 3 along line 4-4 in FIG. 5.
Figure 5:
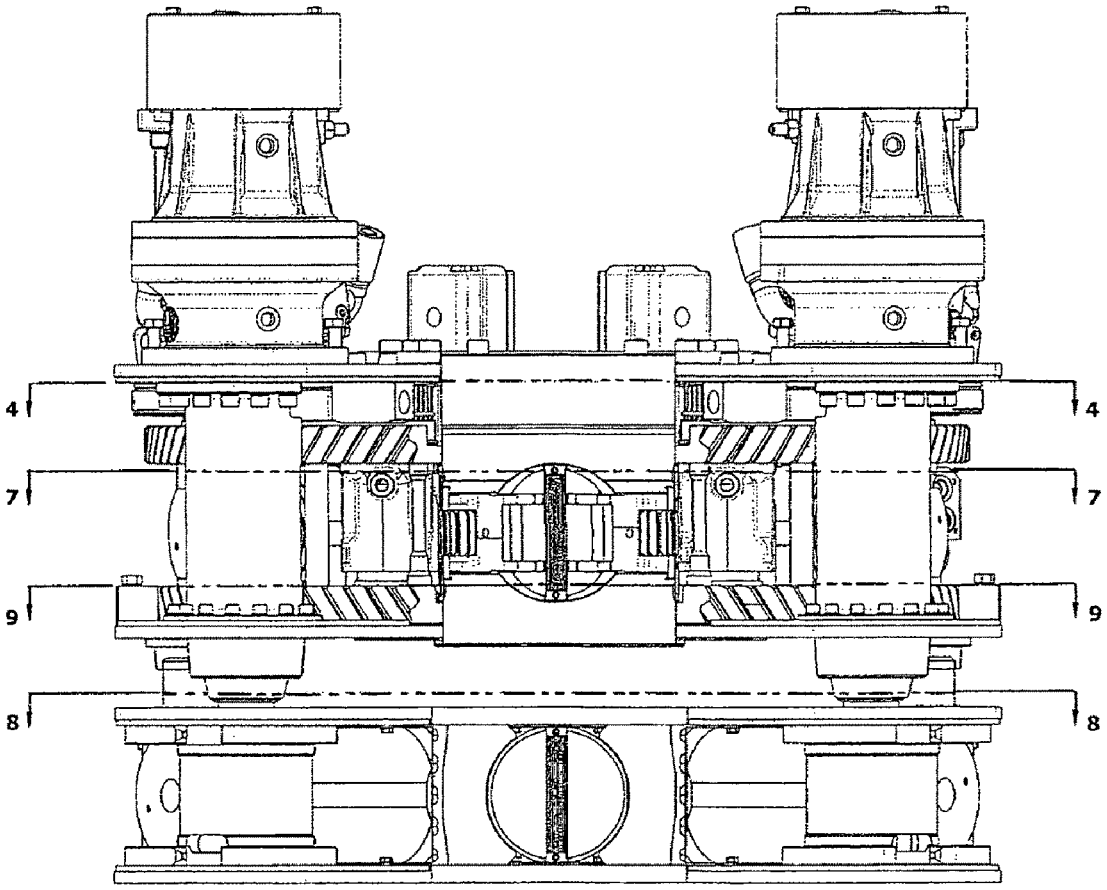
FIG. 5 is, in front elevation view, the power tong of FIG. 1 with the thread compensator cylinders retracted.
Figure 5A:
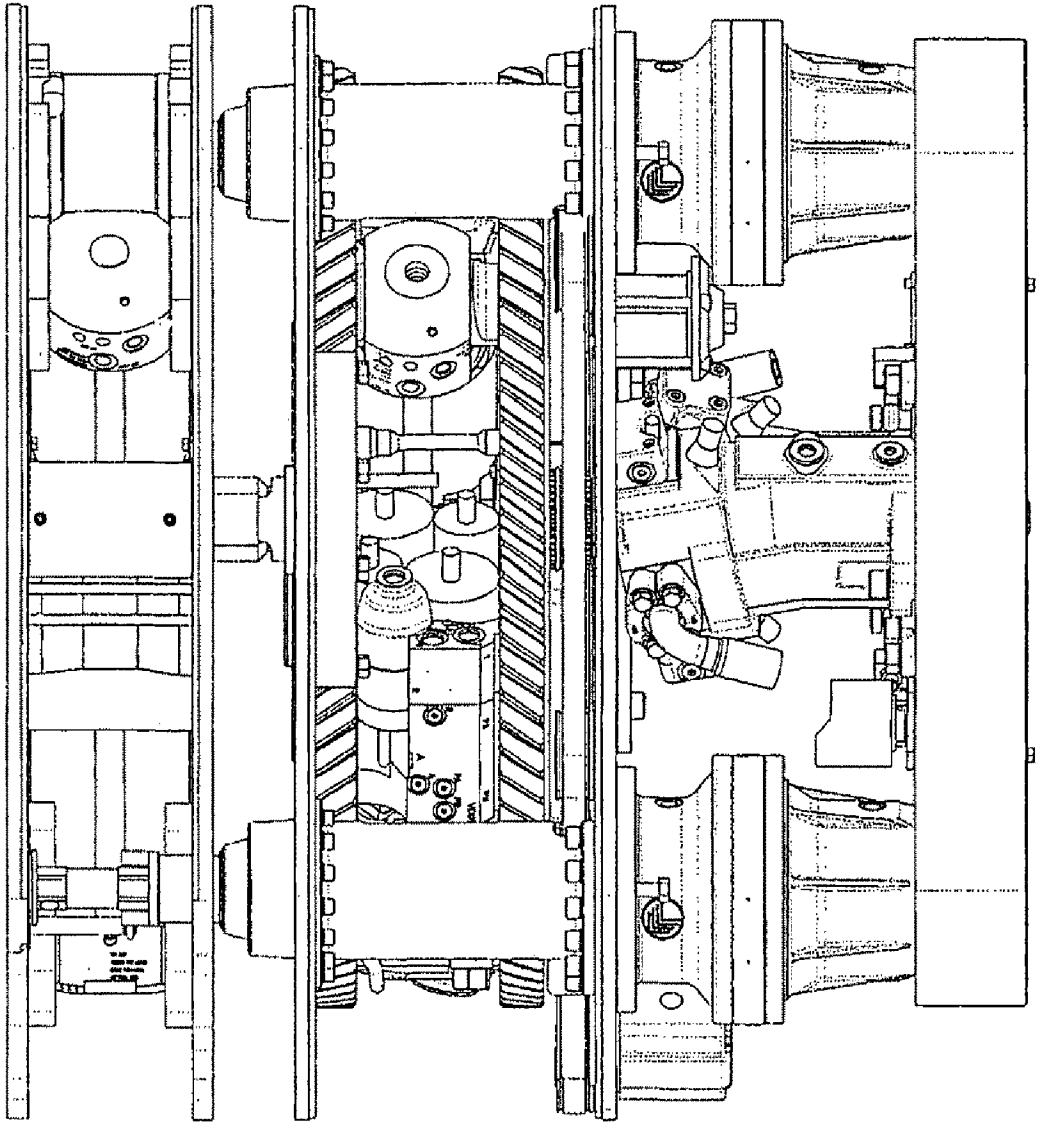
FIG. 5*a* is, in side elevation view, the power tong of FIG. 5 with the thread compensator cylinders extended.
Figure 5B:
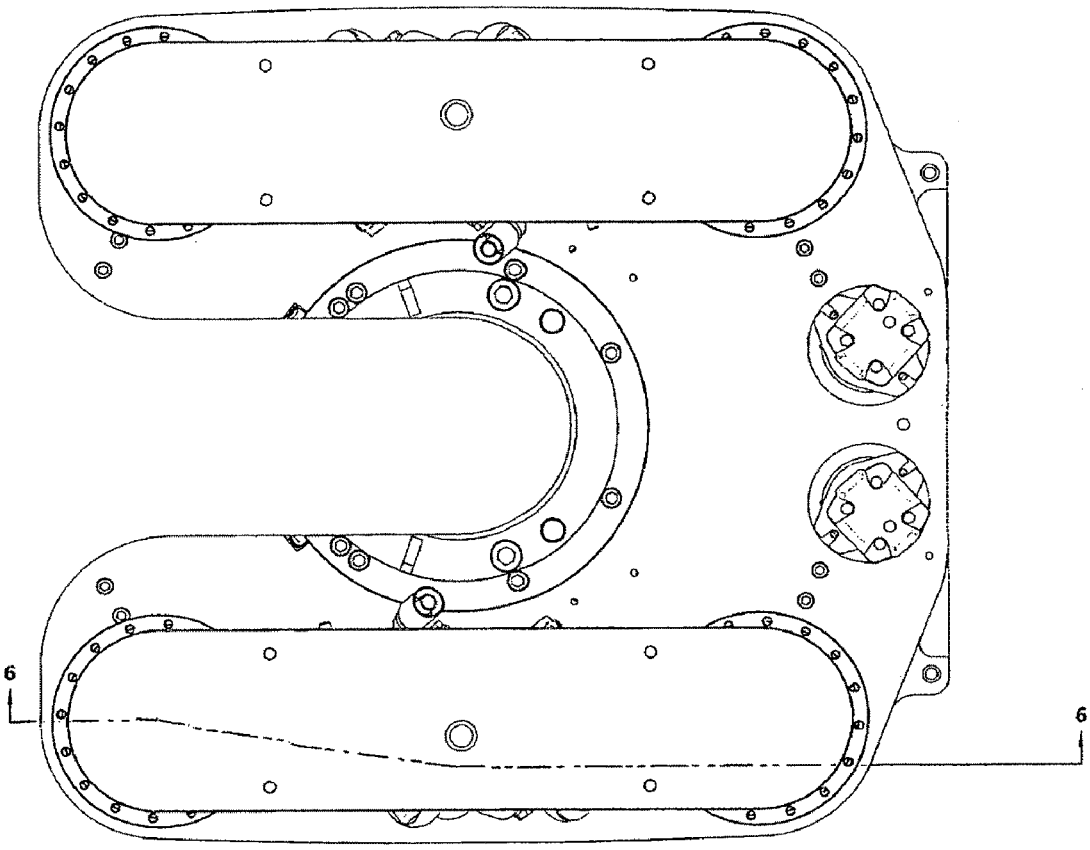
FIG. 5*b* is a plan view of the power tong of FIG. 5.

Serpentine belt 20 is driven by two serpentine drive hydraulic motors 18 driving drive sprockets 26*a* which collectively provide a secondary drive powering the grippers on the rotary jaw. Drive sprockets 26*a* rotate serpentine belt 20 about idler sprockets 26 mounted to drive section 10 and six serpentine drive node sprockets 32*a*-32*f* mounted on the rotary jaw section 22. The serpentine drive node sprockets include in particular two generator drive sprockets 32*a* and 32*b*, two pump drive sprockets 32*c* and 32*d* and two rotary jaw idler sprockets 32*e* and 32*f*. In the illustrated embodiment, the generator drive sprockets, 32*a* and 32*b*, transmit rotary power to generators 34, and the pump drive sprockets 32*c* and 32*d* transmit rotary power to hydraulic pumps 36 by the action of serpentine belt 20 engaging the upper groove of sprockets 32*a*, 32*b*, 32*c* and 32*d*. A synchronization belt, 28*a*, connects the lower portions of the rotary-jaw sprockets 32*a*-32*f*. Thus as the rotary jaw section 22 rotates on axis of rotation A about its full three hundred sixty degree rotational range of motion, even though serpentine belt 20 cannot extend across the opening throat 38 because such a blockage would restrict selective positioning of the pipe along the slot into the tong, serpentine belt 20 wraps in a C-shape around the serpentine drive node sprockets 32. Serpentine belt 20, driven by drive sprockets 26*a*, runs on pulleys 26, 26*b*-26*c* mounted to, so as depend downwardly from, main drive section 10. The extent of the C-shape of serpentine belt 20 provides for continual contact between serpentine belt 20 and a minimum of three of the rotary jaw sprockets 32*a*-32*f* as the rotary jaw rotates relative to the main drive. The synchronization belt 28 mounted on the rotary jaw maintains rotation of the individual rotary-jaw sprockets as they pass through the serpentine gap 29 seen in FIG. 4, that is, the opening between idler pulleys 26*b* and 26*c*. Synchronization belt 28 synchronizes the speed and phase of the rotation of each of the rotary jaw drive sprockets 32*a*-32*f* to allow each of them in turn to re-engage the serpentine belt 20 after they are rotated across the serpentine gap 29 by the action of the rotary jaw rotating relative to the main drive.

As an example, when rotary jaw section 22 rotates in direction B, pump drive sprocket 32*c* will reach the serpentine gap 29 and as that sprocket crosses gap 29 it is disengaged from belt 20, during which time sprocket 32*c* and its corresponding pump continues to operate as it is driven by synchronization belt 28*a* rather than the serpentine belt 20. When rotation continues such that pump drive sprocket 32*c* passes for example beyond (farther counter-clockwise) idler sprocket 26*c* during unscrewing of pipe 8 then pump drive sprocket 32*c* will re-engage with serpentine belt 20. The process repeats in succession as each of the six rotary jaw drive sprockets 32*a*-32*f* passes across gap 29 between idler sprockets 26*b* and 26*c*.

Idler sprocket 26*c* is spring-mounted by means of resiliently biased tensioner arm 26*c* to maintain minimum tension in the serpentine belt 20 regardless of the rotational position of the rotary jaw section 22. This is advantageous as there is a small variation in the length of the path of the serpentine belt 20 as the rotary jaw section 22 rotates about axis A.

The serpentine belt 20 is preferably a toothed synchronous drive belt in order to minimize belt tension requirements. The use of a drive belt having teeth (not shown) allows for small sprocket diameters and avoids dependence on friction which could be compromised by fluid contaminants. The serpentine belt may be double-toothed (that is, have teeth on both sides) or may be single-toothed with the teeth facing inward on the inside portion of the C-shaped loop and facing outward on the outer side portion of the C-shaped loop, where the serpentine drive motors 18 and corresponding drive sprockets 26*a* are positioned outside the C-shaped loop.

During operation of the tong the secondary drive (drive motors 18) and belt 20 run continuously to deliver power to the on-board pumps and generators by means of the drive node sprockets 32*a*-32*d*. Rotation of the rotary jaw by the operation of the primary drive acting on the pinions 56 and ring gears 30*a* and 30*b* does not substantially affect the powering of the on-board accessories (pumps and generators) because the belt 20 is run at substantially an order of magnitude greater speed than the speed of rotation of the rotating jaw. The rotation of the rotary jaw only adds or subtracts a small amount of speed to the rotation of the drive node sprockets.

In an alternative embodiment the serpentine drive may be split into two or more separate 'C' sections. Three separate synchronization belts may also be used instead of the single synchronization belt 28*a*. Alternatively, a roller chain could be used instead of the belt for the serpentine drive but likely would add lubrication requirements, would be noisier and would have a shorter life. The number of serpentine drive nodes may be increased or decreased and the number of idlers 26 may also vary.

Upper rotary jaw gear 30*a* and lower rotary jaw gear 30*b* are parallel and vertically spaced apart so as to carry therebetween hydraulic pumps 36, generators 34, the rotary jaw hydraulic system, rotary jaw electrical controls and the array of three radially disposed hydraulic gripper actuators 44*a*, 44*b*, and 44*c*, all of which are mounted between the upper and lower rotary jaw ring gears 30*a* and 30*b* for rotation as part of rotary jaw section 22 without the requirement of external power lines or hydraulic lines or the like. Thus all of these actuating accessories, which are not intended to be limiting, may be carried in the rotary jaw section 22 and powered via a nested transmission, nested in the sense that the C-shaped synchronization drive loop mounted on the rotary jaw, exemplified by belt 28*a*, is nested within so as to cooperate with the C-shaped serpentine drive loop mounted to the main drive, exemplified by belt 20.

Thus as used herein, the serpentine belt 20 and paired drive pulley transmission is herein referred to generically as a form of nested transmission. The nested transmission transfers power from the fixed stage to the rotational stage in a continuous fashion as, sequentially, one element after another of the rotational drive elements on the rotating stage are rotated through and across throat 38 and gap 29 allowing selective access of the tubular 8 to the center of the stage.

Other nested transmissions as would be known to one skilled in the art are intended to be included herein so long as the drive from the fixed stage to the rotating stage is substantially continuous as the rotating stage rotates sequentially one after another of the rotatable drive elements mounted on the rotating stage across the opening into the stage which provides selective access of the tubular to center 40.

For proper operation of the tong, it is desirable that the gripper cylinders 44 clamp the tubular 8 at or very near the rotational center axis of the tong. It can be readily seen that gripping the tubular 8 with a significant offset from the center axis would result in wobble or runout of the tubular when spinning in or out and could result in thread damage, excessive vibration, damage to the machine and inaccurate torque application.

Figure 7:
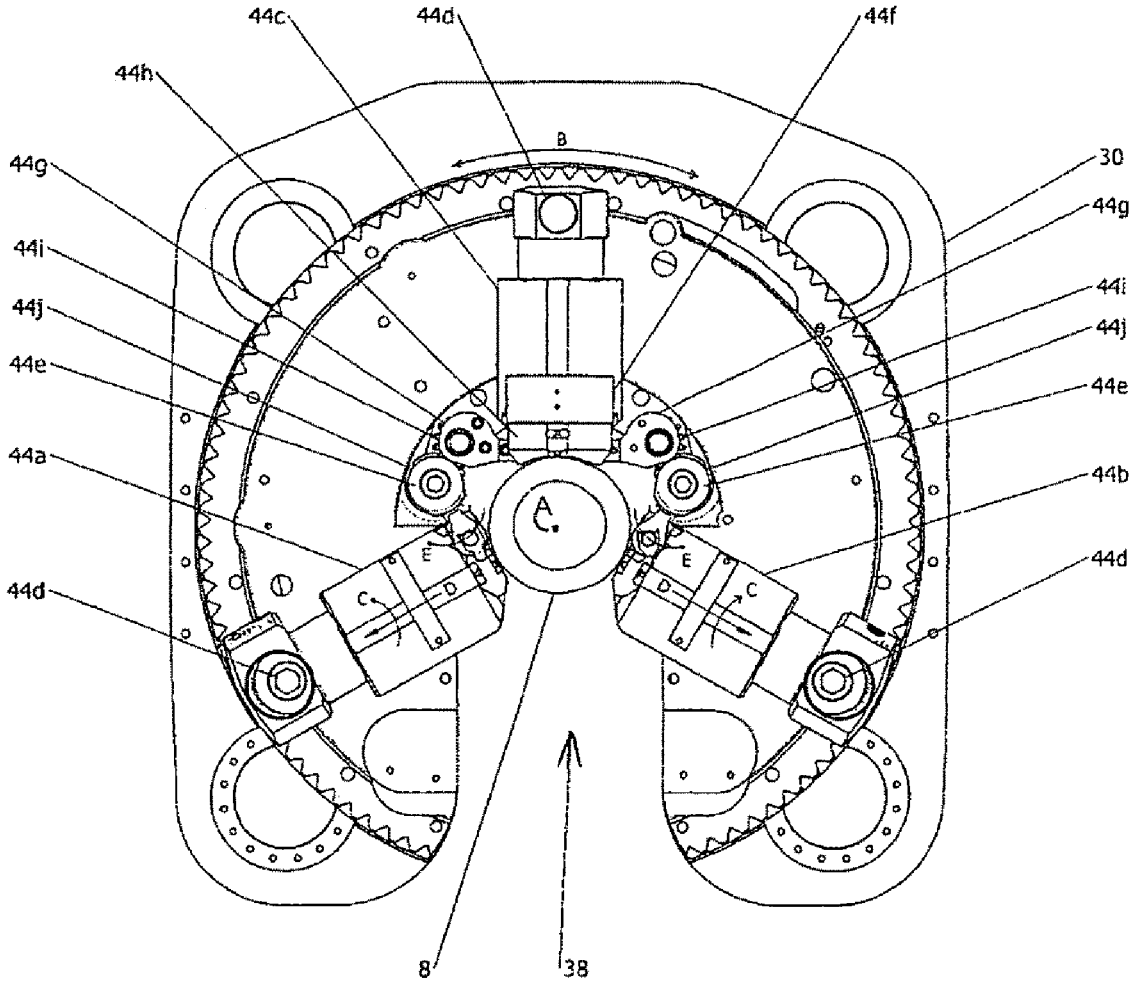
FIG. 7 is a partially cut away view along line 7-7 in FIG. 5.
Figure 8:
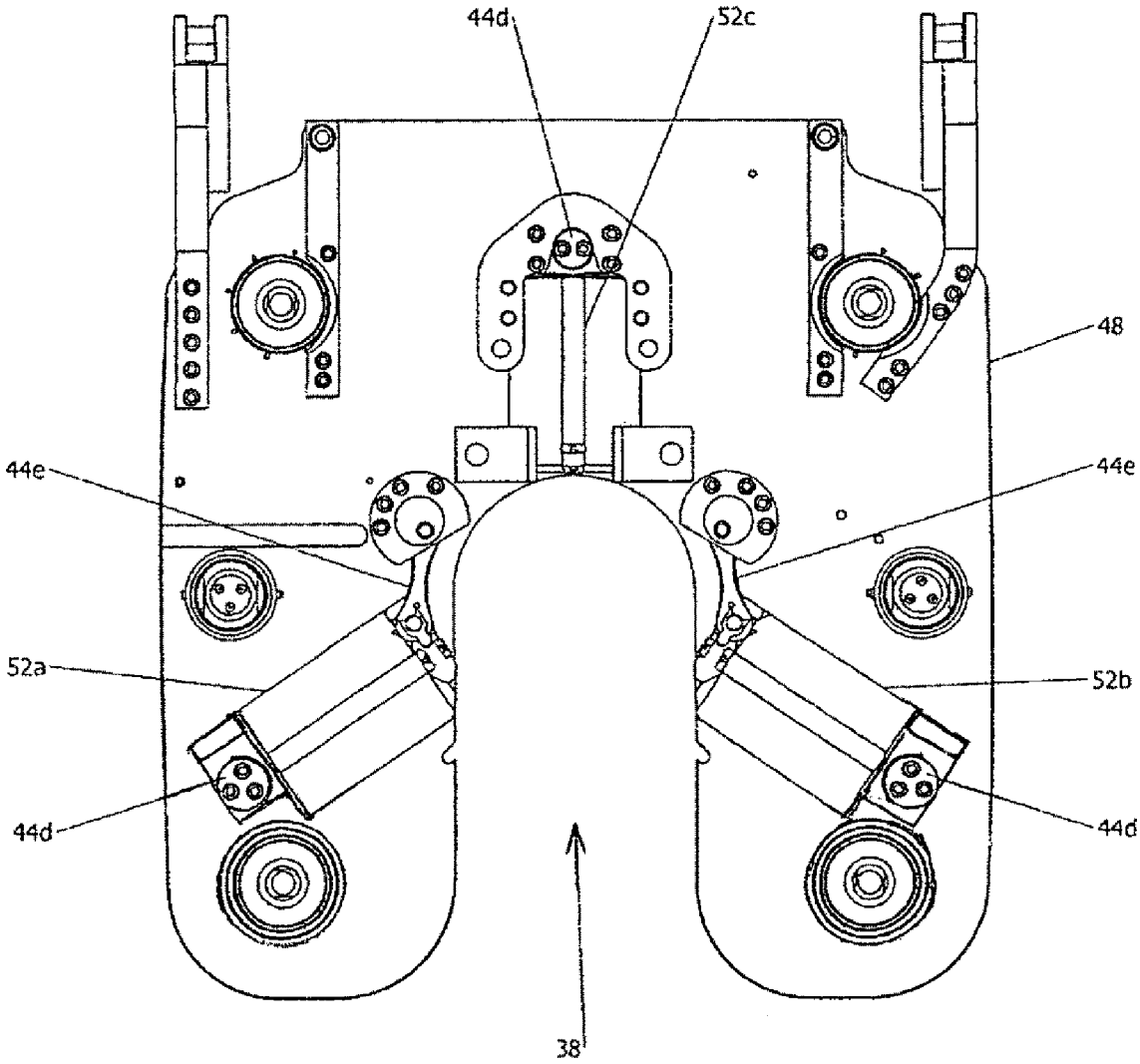
FIG. 8 is, in partially cut away view, along line 8-8 in FIG. 5.
Figure 9:
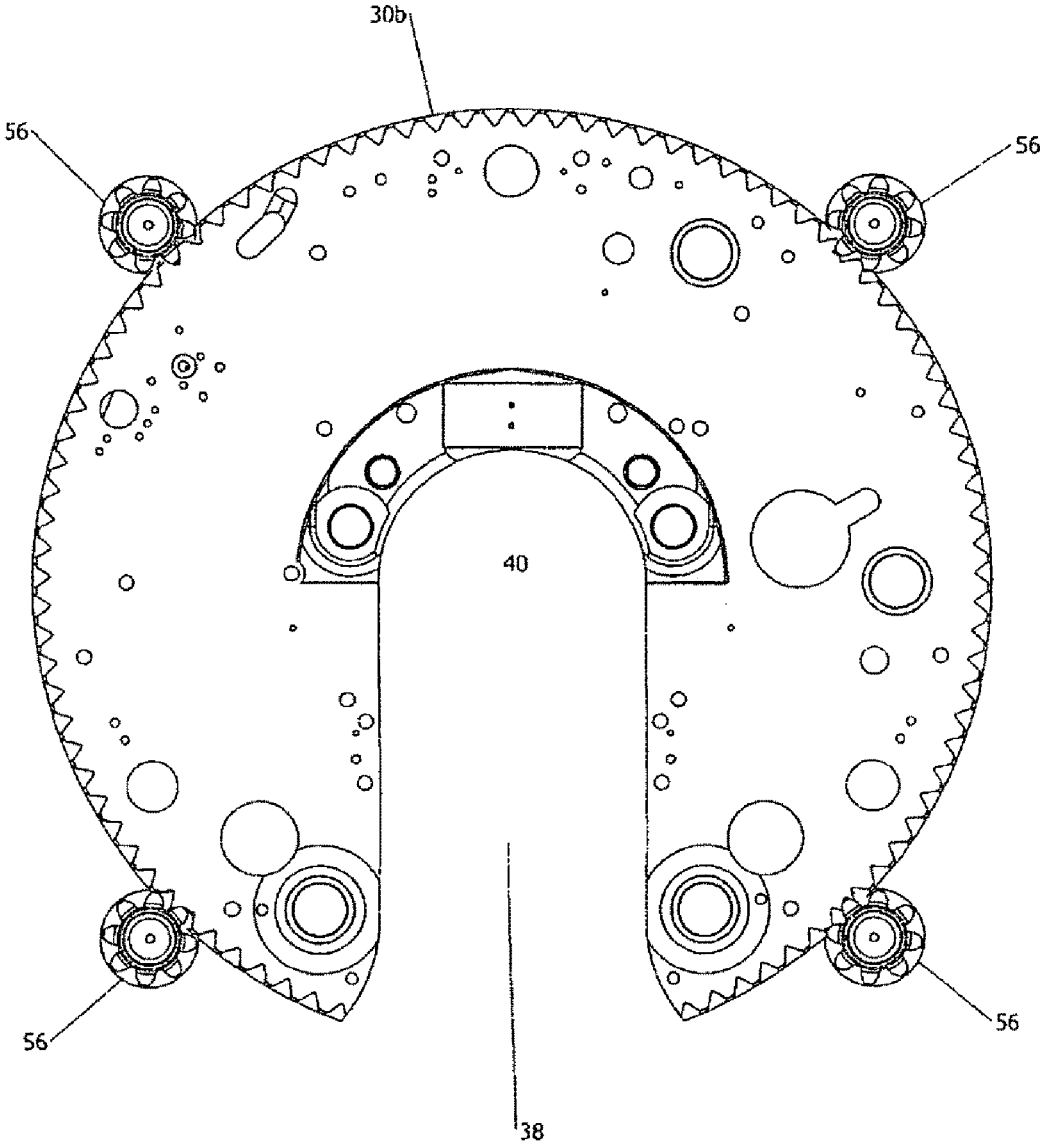
FIG. 9 is, in partially cut away view, along line 9-9 in FIG. 5.

As described above, the rotary jaw preferably has three gripper cylinders 44*a*, 44*b* and 44*c* arranged radially around the tubular 8 and spaced nominally 120 degrees apart as shown in FIG. 7, leaving the throat opening 38 leading into the center 40 of the yoke, centered in axis A, clear when the gripper cylinders are retracted.

The gripper cylinders are pinned at their outboard end to the rotary jaw gears by means of pins 44*d*. Pins 44*d* react the grip cylinder radial clamping force to the rotary jaw gear structure 30. Pins 44*d* may include an eccentric range adjustment system.

The gripper cylinders are preferably mounted rod-out, body-in for best structural advantage but the mounting could be inverted.

Near the inboard end of each gripper cylinder, the lateral force due to the applied torque must be reacted to the rotary jaw structure 30, without allowing excessive side loading of the internal working parts of the cylinders. For the side gripper cylinders 44*a* and 44*b* adjacent to the throat opening 38, this lateral force is reacted by reaction links 44*e* which pivotally connect the inboard end of the gripper cylinders to the rotary jaw structure 30. For the rear gripper cylinder 44*c*, the lateral force is reacted by cylindrical guide 44*f*.

It will be appreciated that the inboard ends of side gripper cylinders 44*a* and 44*b* move in an arc as the gripper cylinders are extended or retracted. For the side gripper cylinders 44*a* and 44*b*, the geometry of reaction links 44*e* is optimized to minimize deviation from the nominal gripper cylinder radial axis over the gripping diameter range to angles typically less than 1 degree. The gripper cylinders 44*a* and 44*b* will however swing significantly from the nominal gripper cylinder radial axis, in the order of five degrees, when they fully retract to clear the throat opening 38. It is an advantage of the link design that it requires less stroke to clear the throat opening 38 due to the swing associated with the arc of reaction links 44*e*, which ultimately allows a more compact rotary jaw 30 and hence a more compact tong. That is, the combination of the swing in direction C with the retracting stroke in direction D results in less of a stroke length required to clear throat 38 than merely using a retraction stroke without swing. The amount of swing is governed by the radius of arc E associated with rotation of the reaction links 44*e* and the length of the required stroke in direction D.

Synchronization links 44*g* are pivotally mounted to the rotary jaw structure 30 and engaged in lateral grooves 44*h* on either side of the rear gripper cylinder 44*c*. Synchronization links 44*g* do not react the lateral force due to torque but rather control the extension magnitude of the rear gripper cylinder 44*c* in coordination with the side gripper cylinders 44*a* and 44*b*, resulting in centralization of the gripped tubular 8 at the rotational axis A of the rotary jaw 30.

Reaction links 44*e* and synchronization links 44*g* have timing gears 44*j* and 44*i* respectively attached or integral at the ends that pivot on the rotary jaw structure 30. Reaction link timing gears 44*j* engage with synchronization link timing gears 44*i*, constraining the displacement angles of the synchronization links 44*g* equal and opposite to the displacement angles of reaction links 44*e*. The geometry is optimized to ensure that the tubular 8 is gripped very close to the rotational axis A of the rotary jaw, within about one mm, over the entire gripping diameter range.

The back-up jaw section 24 as shown in FIGS. 5, 5*a*, 6 and 8 is typically mounted to a tong positioning system capable of holding the tong assembly level and enabling vertical and horizontal positioning travel. The tong may be pedestal-mounted on the rig floor, mast-mounted, track-mounted on the rig floor or free hanging from the mast structure. It may also be mounted at an angle for slant drilling application or with the pipe axis horizontal.

The back-up jaw section 24 includes a parallel spaced apart array of planar jaw frames and in particular an upper backup jaw plate 48*a* and a lower backup jaw plate 48*b*. Backup jaws plates 48*a* and 48*b* are maintained in their parallel spaced apart aspect by structural members 48*c*. Thread compensator cylinders 50 actuate so as to extend bolts 46 on rods 50*a* in direction F so as to selectively adjust the vertical spacing between the rotary jaw section 22 and the backup jaw section 24. Thus with the cylindrical threaded joint 8*a* of tubular 8 held within cylinders 52*a*-52*c* in the backup jaw section 24 (that is with joint 8*a* held lower than shown in FIG. 3 so as to be clamped between the grippers of the lower back-up jaw section), and with threaded tapered female end or box (not shown) extending upwardly from the joint 8*a* held within cylinders 52*a*-52*c*, as the rotating jaw 22 is rotated relative to the fixed back-up jaw section 24 so as to rotate tool joint box relative to the pin, the rotating jaw 22 and back-up jaw section 24 may be drawn towards one another by the retraction of rods 50*a* into thread compensator cylinders 50 in direction F or alternately, separated from on another by the extension of rods 50*a* from cylinders 50. This action serves to compensate for the axial thread advance of the tubular as it is screwed in or out and avoids excessive axial forces on the tubular threads. The combined upward force exerted by thread compensator cylinders 50 is controlled via the hydraulic pressure to approximately equal the weight of the upper tubular. Thus a further advantage of the invention is a reduction of tubular thread wear because the threads are "unweighted" when spinning in or out The spacing between plates 48*a* and 48*b* defines a cavity in which is mounted the array of hydraulic gripper cylinders 52*a*, 52*b* and 52*c* positioned radially about axis A at approximately equal angular spacing. Hydraulic cylinders 52*a*-52*c* are disposed radially inward in an arrangement corresponding to that of cylinders 44*a*-44*c* so that the operative ends of the actuators which may be selectively actuated telescopically into the center of yoke 40 so as to clamp therein a tubular 8 and in particular a lower portion of a tubular joint while an upper portion of the tubular joint is clamped within cylinders 44*a*-44*c* and rotated in rotary jaw section 22 in direction B about axis of rotation A relative to the fixed actuating stages of main drive 10 and back-up jaw section 24.

As shown in FIG. 1, the rotary jaw assembly 22 is maintained in alignment with axis of rotation A by means of upper and lower guide bearings 54*b* and 54*a*. The top of the rotary jaw has a cylindrical race 54*d* bolted to the top surface. This race slides within upper guide bearing 54*b* fixed to the top plate of the rotary jaw frame. Similarly, the bottom surface of lower rotary jaw gear 30*b* is profiled to create a race 54*c*. This race slides within a lower guide bearing 54*a* fixed to the lower plate of the rotary gear frame. The upper and lower bearing rings are interrupted, that is do not complete a full circle, so as to match the opening throat 28 of the rotary gear frame. Another guide method may include guide rollers which are rotatably mounted in an array circumferentially around the outer circumference of the rotary jaws with their rotational axis parallel to rotation axis A. In the present embodiment, upper and lower guide bearings 54 centralize the rotary jaw assembly along rotational axis A and ensure proper meshing of the rotary jaw gears 30 with the drive pinions 56.

The drive pinion sets 56, of which there are a minimum two but ideally four, are arranged circumferentially around the rotary jaw 22 and intermesh and engage helical teeth 56*a* with corresponding gear teeth on the outer circumference of rotary jaw ring gears 30*a* and 30*b* so that as pinion sets 56 are driven by main drive hydraulic motors 16 via gear reduction devices 16*a* ring gears 30*a* and 30*b* are simultaneously rotatably driven (in either direction) about axis of rotation A. Pinions 56 and the corresponding ring gear teeth are helical. Each drive pinion set 56 has its rotational axis parallel to axis A and consists of an upper pinion 56*a* and a lower pinion 56*b*. The helix angles of the upper gear 30*a* and lower gear 30*b* are equal opposite to ensure proper meshing torque splitting between top and bottom gears. The rotary jaw is mounted within a frame or housing 60. The primary drives 12 and driver 18 are mounted on top of housing 60, and back-up jaw section 24 is mounted beneath housing 60.

In the preferred embodiment, the rotary jaw hydraulic system 53 is a dual (high/low) pressure system or infinitely variable pressure system which produces high pressures (in the order of 10,000 psi) necessary for adequately gripping large and heavy-duty tubulars and for applying make-up or break-out torque, and lower pressures (2500 psi or less) to avoid crushing smaller or lighter-duty tubulars. Hydraulic pumps 36, rotationally driven as described above, are fixed-displacement, gear or variable displacement piston pumps. In the idle state, hydraulic pumps 36 charge one or more gas-filled accumulators 55 mounted in or on the rotary jaw section 22 to store energy to enable rapid extension of the gripper actuators 44*a*-44*c*. In this way, very fast gripping speeds may be achieved while keeping the power transmitted by the serpentine belt 20 drive low. That is, although the power supplied via the serpentine drive is small, the rotary jaw hydraulic system must be able to intermittently supply a relatively large flowrate at low pressure for rapid advance of the gripper cylinders until they contact the tubular and also supply a low flowrate at very high pressure, in the order of 10,000 psi, to adequately grip the tubular for torquing operations.

Figure 10:
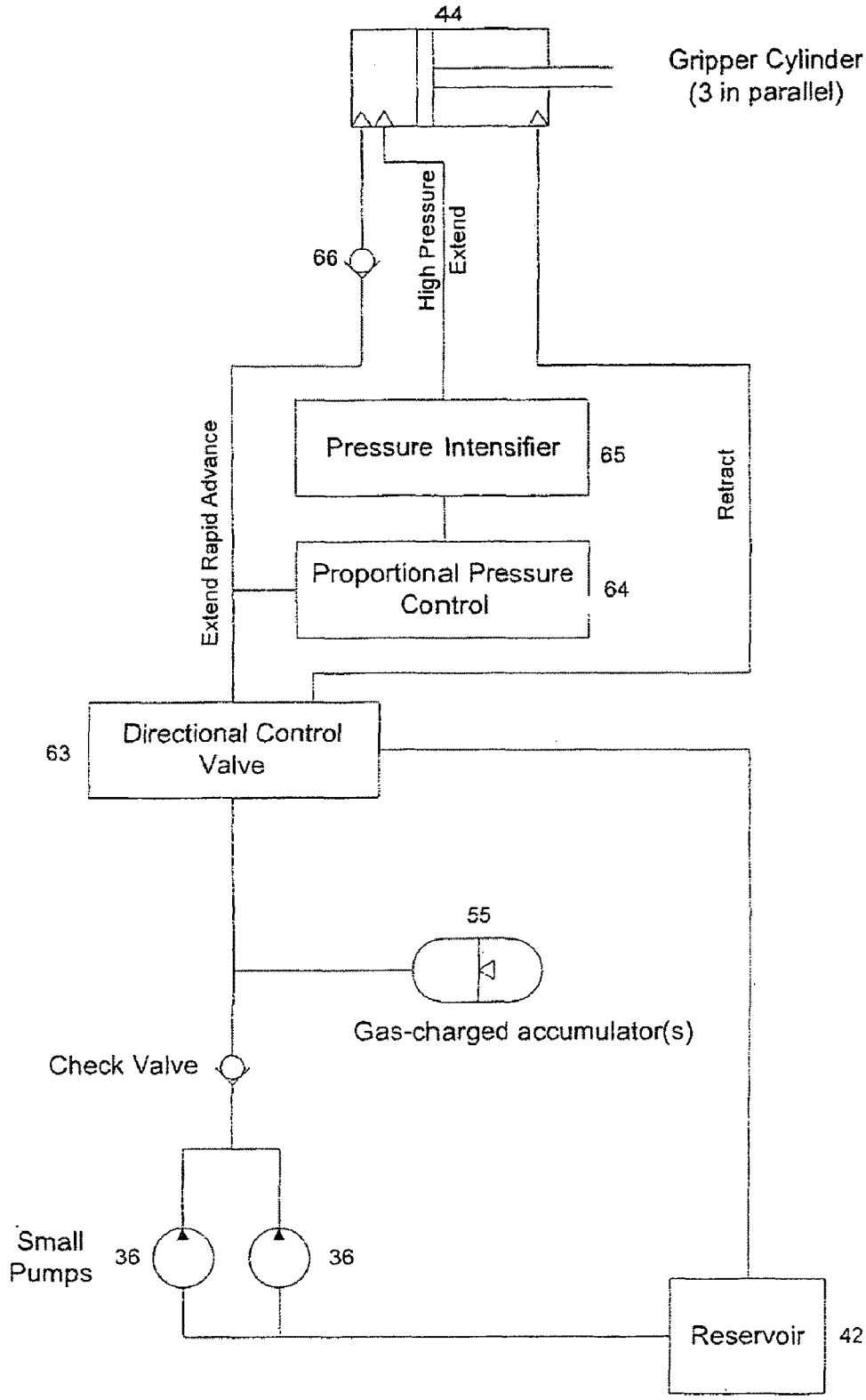
FIG. 10 is a rotary jaw hydraulic schematic.

A schematic of the preferred rotary jaw hydraulic system is shown in FIG. 10. The system has one or two gear or piston pumps 36 of relatively small capacity, within the power limitations of the serpentine drive. When there is no gripping demand, the pumps charge one or more gas-filled accumulators 55 to store energy for intermittent peak demands. A directional control valve 63 directs hydraulic pressure to the gripper cylinders. The directional control valve is solenoid-actuated with the solenoids controlled by the rotary jaw control system. There are two flow paths from the directional control valve 63 to the extend side of the gripper cylinders. The first is the rapid-advance flow path which directs a large flowrate, in the order of thirty-five gallons per minute, from the pump(s) 36 and accumulator(s) 55 to the gripper cylinders at relatively low pressure, in the order of 2500 psi, for rapid extension of the gripper cylinders until they contact the tubular 8. The second is the high-pressure path in which pressure is regulated by a proportional pressure control valve 64 which is controlled by the rotary jaw control system of FIG. 11. The regulated pressure is supplied to an intensifier 65 which boosts the pressure by a factor in the order of 4:1 to supply high pressure, in the order of 10,000 psi, to the gripper cylinders. A check valve 66 prevents the high pressure fluid from flowing back into the rapid-advance low pressure flow path. The directional control valve 63 can also be solenoid actuated to direct fluid to the rod side of the gripper cylinders for retraction.

The use of high grip pressures, in the order of 10,000 psi, allows the use of compact gripper cylinders which results in a compact tong. By using the intensifier 65 to build the high grip pressure, no high pressure control valves are required.

When torquing, the control system monitors the applied torque and controls the grip pressure via proportional pressure control 64 at an appropriate level to avoid slippage of the tubular 8 clamped in the three gripper cylinders. The grip pressure is adaptive according to applied torque which avoids both slippage caused by inadequate pressure and crushing of the tubular 8 caused by excessive pressure.

It can be seen that in spite of the small input power, the hydraulic system can intermittently supply large flowrates for rapid grip cylinder advance and high pressures for high-torque operations. The system can regulate the grip pressure, adapting to the applied torque, for optimum gripping performance.

Figure 11:
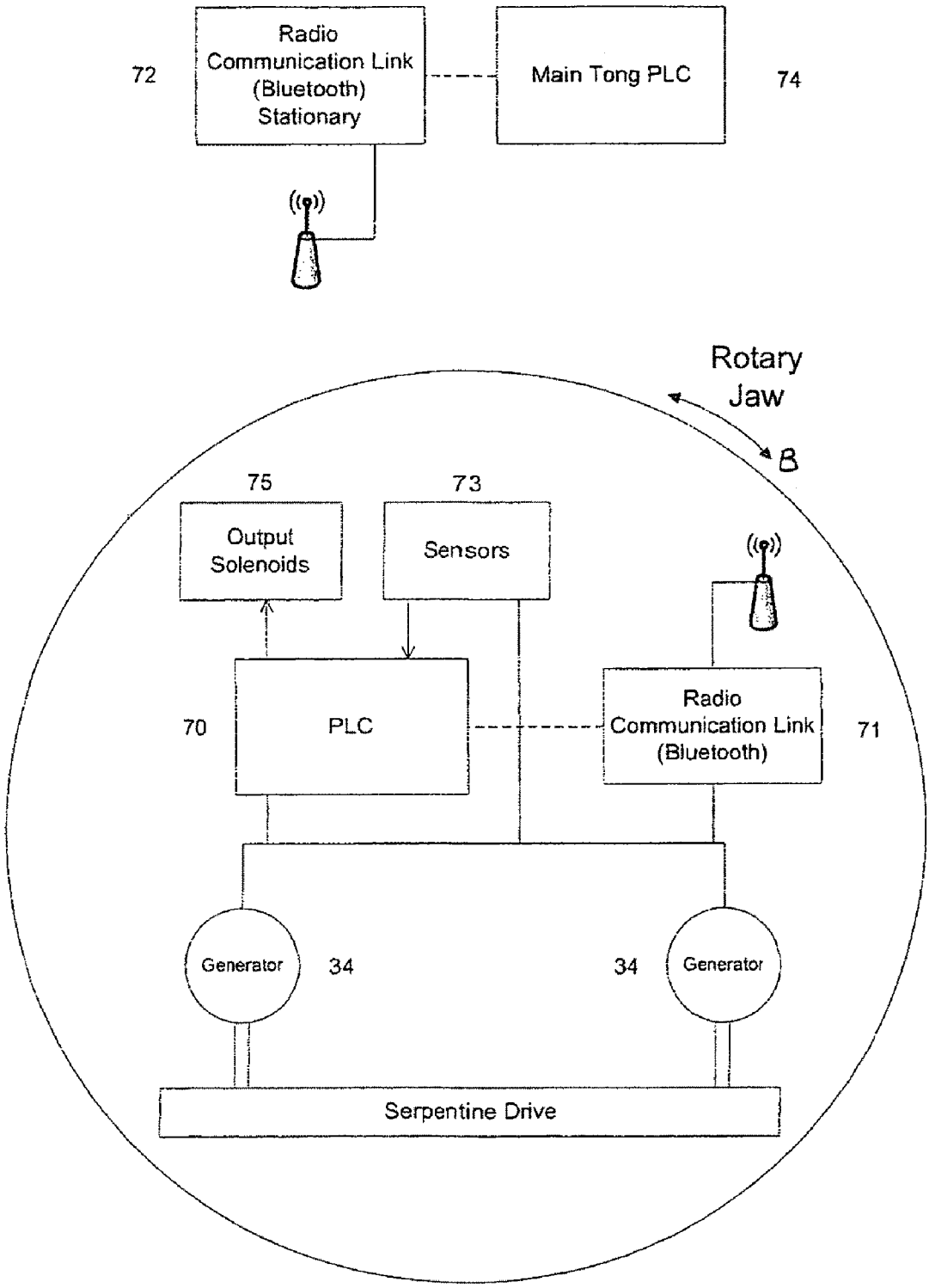
FIG. 11 is a rotary jaw control system circuit.

The rotary jaw control system seen in FIG. 11 activates and de-activates the gripper cylinders at the operator's discretion, regulates grip pressure and monitors system function without any power supply or control wires from or to the fixed part of the tong, because the rotary jaw is fully rotatable and the open throat of the yoke precludes the use of any slip rings which are commonly used to transmit electrical power and control signals to a rotating element.

One or two generators 34 are driven by the serpentine belt drive 20. They supply power, preferably 24 volts DC, to a programmable logic controller (PLC) 70, a radio communication link 71 and a number of sensors 73.

The radio communication link 71, which may advantageously be a Bluetooth™ device, communicates wirelessly with a similar device 72 mounted on the stationary section of the tong. The two radio communication links, 71 and 72, act as a wireless communication bridge between the main tong control system 74 and the rotary jaw PLC 70.

The rotary jaw PLC 70, as directed by the main tong control PLC 74, controls the output solenoids on directional control valve 63 to extend and retract the gripper cylinders 44*a*-44*c* and the proportional pressure control 64 to control the grip pressure. It also receives feedback from sensors 73 on the rotary jaw for such parameters as (possibly including but not limited to) grip pressure, hydraulic pump pressures, grip position and hydraulic oil temperature.

It can be seen that the rotary jaw control system is fully self-contained allowing unlimited rotary jaw rotation, with no wired connection to the main control system but with full control and monitoring communication.

For proper make-up of drilling tubulars, it is necessary to measure the applied make-up torque and cease torquing at a prescribed torque value or within a range of allowable torque values.

For typical drillpipe or drill collar connections, which have relatively high make-up torque specifications and a relatively wide torque tolerance range, the torque can be adequately computed by a programmable logic controller (PLC) 112 proportional to the differential pressure applied to the main drive motors 16 and measured by pressure sensors.

For make-up of casing or some specialized drillpipes, the make-up torque specification can be much lower and the torque tolerance range smaller such that a more accurate means of torque measurement is desired, without inaccuracies due to drive friction and hydraulic motor efficiency.

Figure 6:
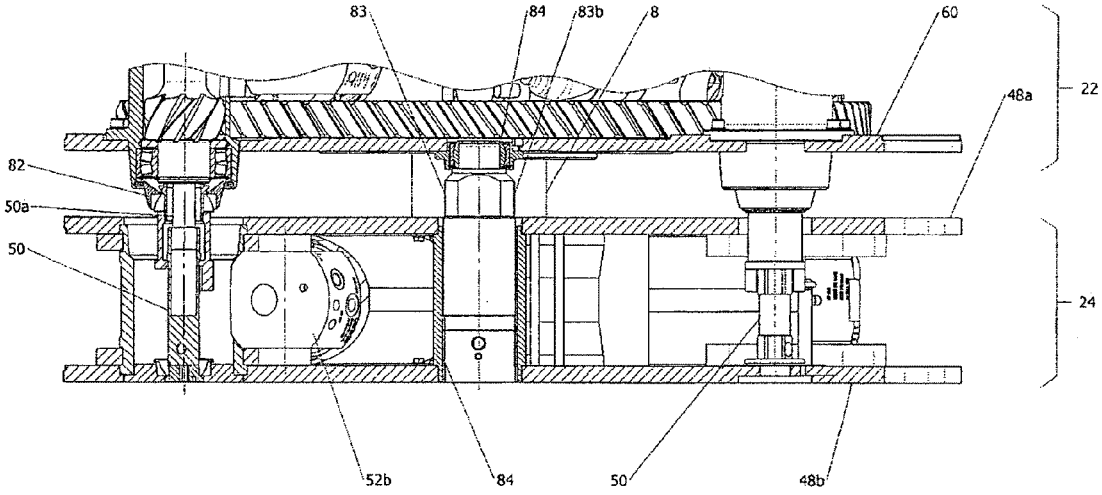
FIG. 6 is a section view along line 6-6 in FIG. 5*b*.

In the present invention, the rotary jaw section 22 and rotary jaw frame 60 and drive structure 12 are rotationally independent of the backup jaw section 24. As shown in FIG. 6 the rotary jaw is axially supported by the thread compensation cylinders 50 which are mounted with spherical bushings 82 at both ends so that they do not react any torque between the rotary jaw frame 60 and the back-up jaw section 24.

Rotary jaw frame torque is reacted to the backup jaw section 24 via two reaction beams 83 mounted in the backup jaw section 24 and with their top ends connected to the rotary jaw frame via spherical bearings 84. The reaction beams 83 are free to slide vertically relative to the backup jaw section 24 in guide bushings 84 to allow for thread advance compensation travel. Guide bushings 84 restrain the reaction beams 83 laterally so that they are effectively cantilevered upward from the backup jaw section 24. The torque of the rotary jaw frame 60 is reacted at the top of the reaction beams 83.

For accurate torque instrumentation, the reaction beams 83 are optionally fitted with electronic strain gauges to form shear-beam load cells 83*b*. The signals from the load cells 83*b* are input to the PLC 112 for torque instrumentation.

When breaking out (unscrewing) drilling tubulars; it is often difficult to identify the axial location of the split where the two tool joints meet. It is imperative that the tong be positioned such that the split is located in the axial gap between the rotary jaw grippers and the back-up jaw grippers. If either jaw grips across the split, the tool joint and the tong may be damaged and time will be wasted because the connective will not break out.

Figure 15:
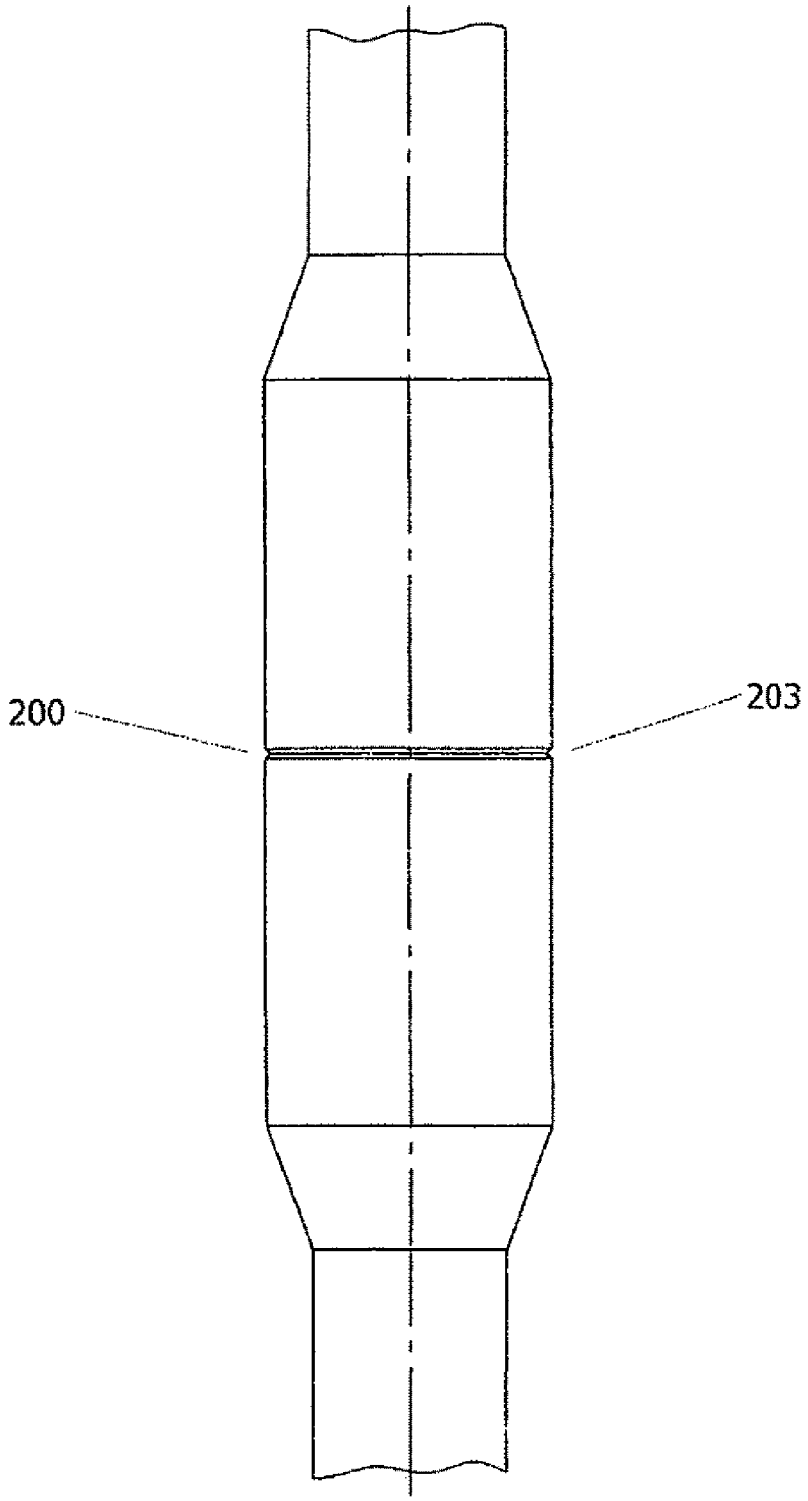
FIG. 15 is, in side elevation view, mated tool joints showing the split seam between the joints.
Figure 16:
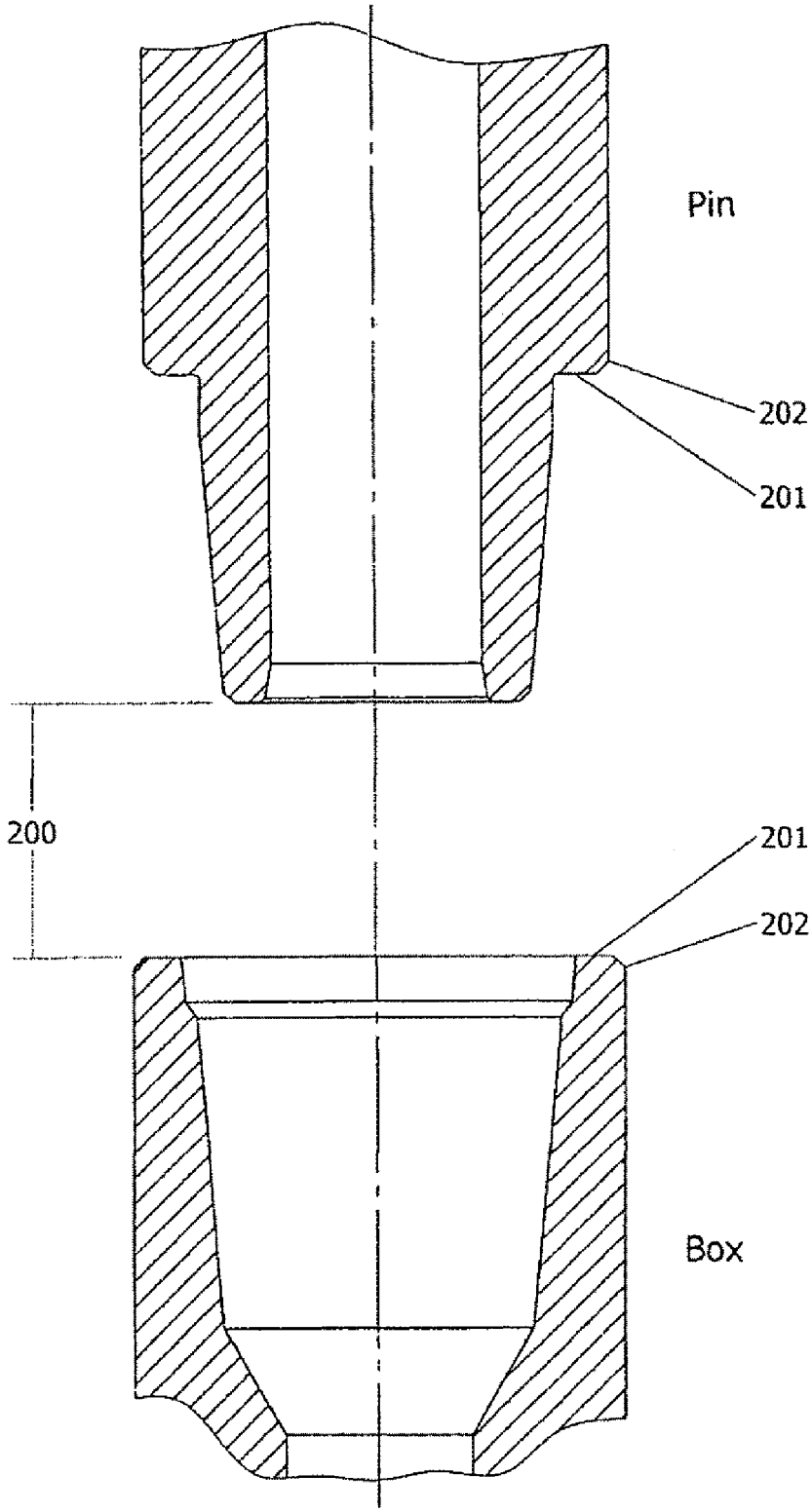
FIG. 16 is, in cross sectional view alone the axis of rotation of the tubular, the mated tool joints of FIG. 15, with the tool joints un-threaded from one another.

As shown in FIGS. 15 and 16, the actual face seam 200 between the mating connection shoulder faces 201 is only marginally visible when the connection is made up and it may be further obscured by drilling fluid. There is typically a shoulder bevel 202 adjacent to each shoulder face 201. The shoulder bevel 202 is typically machined at a 45 degree angle and has a radial dimension typically 2 to 6 mm. The two adjoining shoulder bevels 202 combine to form a connection split bevel V-groove 203. The connection split bevel V-groove 203 is usually sufficiently visible to identify the split axial location for placement of manual tongs in conventional drilling operations. But for a mechanized tong with its operator positioned several feet away from the pipe, it may be difficult to see. Furthermore, the tong may obscure the operator's direct view of the split location. Time will be wasted in identifying the split location, traveling to it and verifying that the split is correctly located in the axial gap between the rotary and back-up jaws.

For automated pipe-handling operations, it is essential for the machine to identify and travel to the correct axial location of the split without control intervention by the operator.

It can be seen that a reliable automated system to detect the location of the connection split would improve speed and efficiency of a mechanized tong and is mandatory for fully-automated tong operations.

Figure 17:
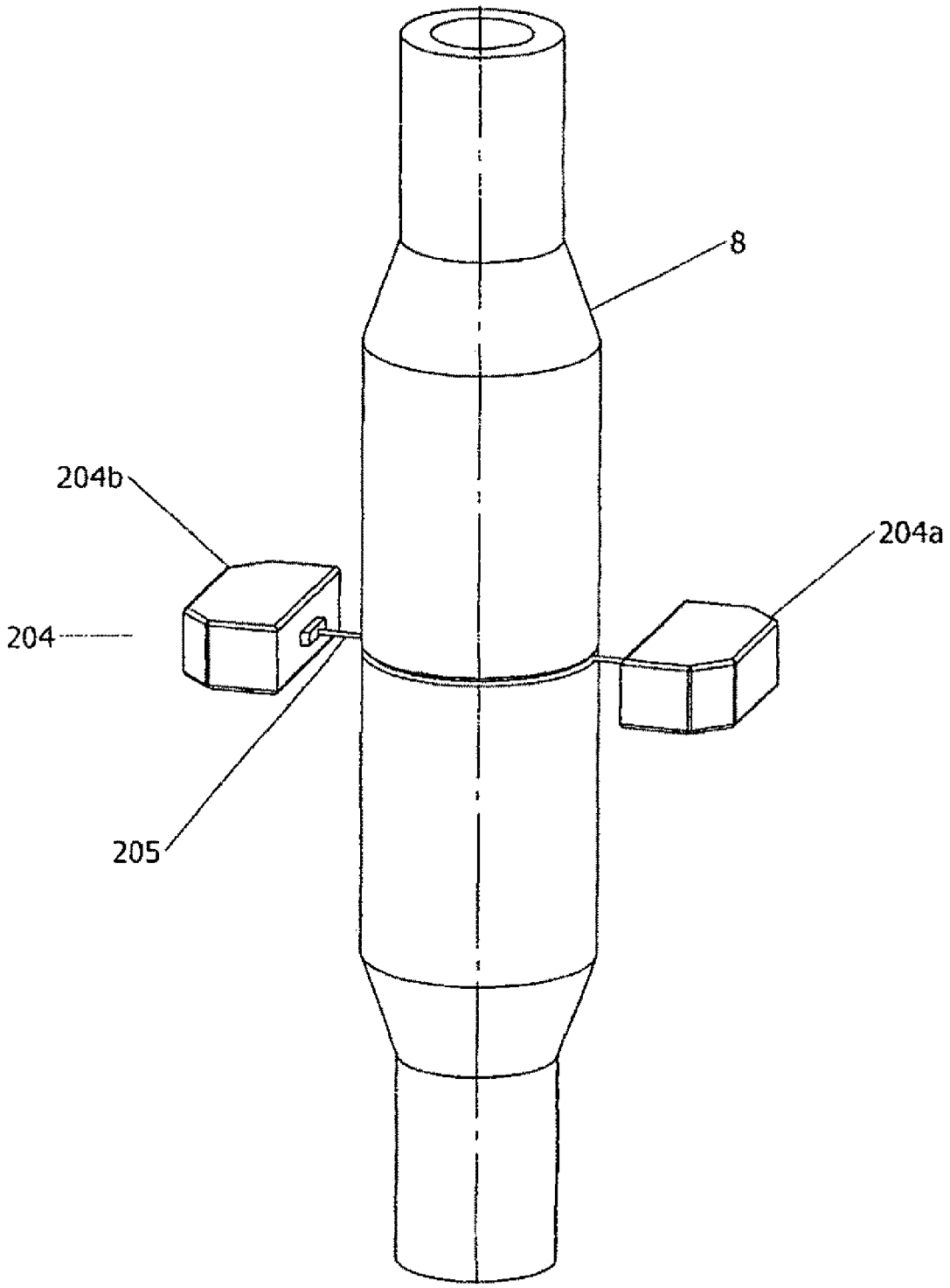
FIG. 17 is, in perspective view, the mated tool joints of FIG. 15 showing a non contact sensor detecting the split seam between the tool joints.

As shown in FIG. 17, an optical caliper system 204 may be used to measure the outside diameter of the tool joint 8. The optical caliper system 204 consists of a light source unit 204*a* which emits a thin band of light 205 (visible spectrum or not) and a receiving unit 204*b* which monitors the dimensional characteristics associated with any portion of the light band 205 which is blocked by a target object such as tool joint 8 located between the source unit 204*a* and the receiving unit 204*b*. The system can quickly and accurately measure the diameter of a cylindrical target object 206 (such as a joint 8) without any physical contact.

The system is installed within, above or below the tong, oriented such that the light band 205 is in a plane perpendicular to the axis of the pipe and with the light band 205 passing across the center axis of the tong so that the pipe will interrupt the light band 205. If the width of the light band 205 is less than the outside diameter of the drill pipe tool joints than a tandem configuration can be employed as shown in FIG. 18.

The system can quickly and accurately measure the diameter of any tubular passing through the plane of the light band(s) 205 and transmit the diameter measurement to the tong control system. Furthermore, as the tong travels axially along the pipe, the tong control system can relate a series of such diameter measurements to the corresponding tong elevations as measured via the control system instrumentation described elsewhere. A diameter profile along the length can thus be created, effectively a virtual diameter versus axial position plot. The control system can compare this diameter profile to the known characteristic of the connection split bevel V-groove 203. When such a profile match is identified, the connection split is located and the corresponding tong elevation is recorded. The tong then travels the contact axial offset distance between the light band 705 axial mounting position and the desired split position between the rotary and back-up jaw grippers.

The control system is programmed to tune out irrelevant variations in the measured outside diameter, such as at the tool joint upset steps. It will also filter out diametral noise associated with surface irregularities such as hardbanding, tong marks or wear grooves.

It can be seen that the system can quickly and accurately locate the axial position of the connection split on the tool joint and works obtrusively and reliably, with no direct contact with the pipe. The detection system has no moving parts.

The automated split detection system will improve the operational speed and efficiency of the tong and will enable automated tong operations.

As mentioned above, the power tong according to the present invention may be mounted in many ways on the drilling rig structure, or it may also be free-hanging from a cable. The mounting method ideally allows the tong to be accurately positioned around the tubular 8 at a large range of elevations, retracts a substantial distance from well center for clearance for other well operations, parks in a small area to minimize space usage on the drilling rig floor, keeps the tong level and allows the tong to be positioned to work at multiple locations such as the mousehole which may not be in the same plane as well center and the tong park location. The mounting system could be capable of rapid movement between working and idle positions but with smooth, stable motions. It should allow the operator to command horizontal or vertical movements or a combination.

Numerous tong or wrench mounting mechanisms exist in the industry. Most are Cartesian (horizontal/vertical) manipulators employing tracks, slides or parallelogram linkages for each motion axis. These mechanisms are simple to control because they directly actuate on the horizontal and vertical axes but they typically have a small range of motion which limits tong functionality and restricts mounting location on the drill floor. They have a large parked footprint which consumes scarce rig floor space and interferes with other well operations. And they have little or no capability to react torque applied to the tong or wrench by a top drive in the rig.

Figure 12A:
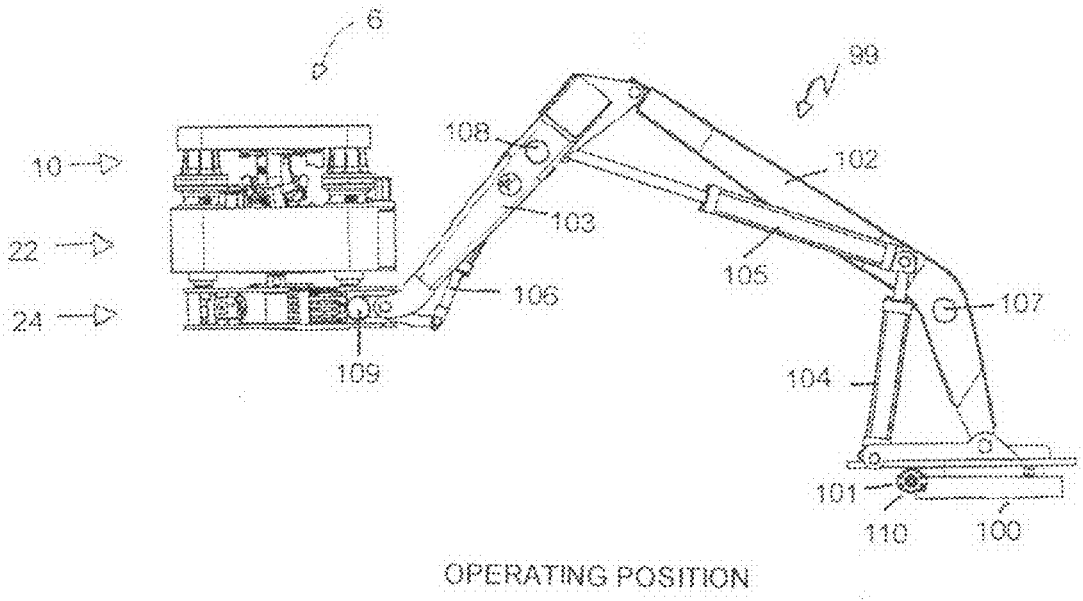
FIG. 12*a* shows a power tong according to the present invention on a manipulator in an extended position.
Figure 12B:
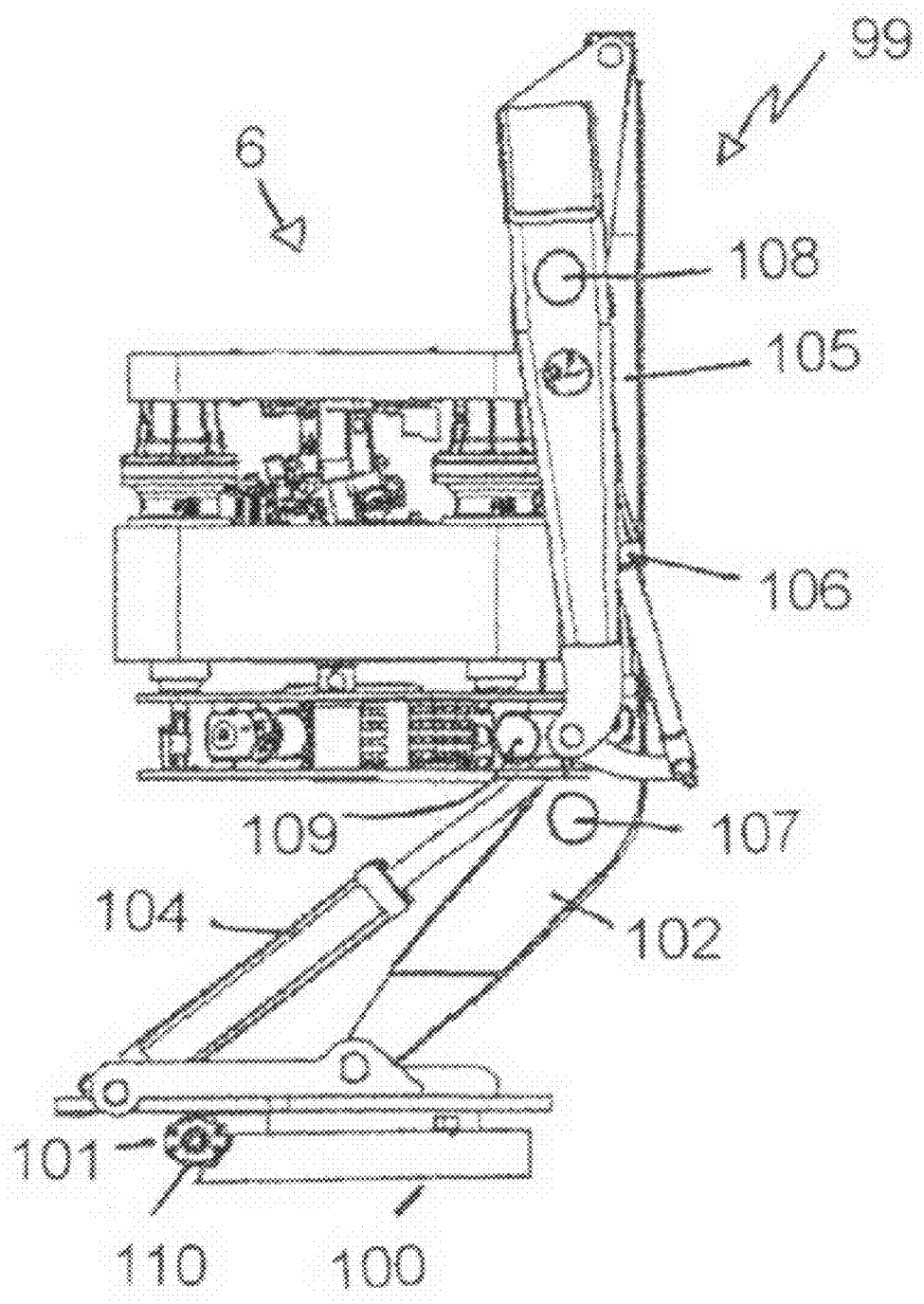
FIG. 12*b* show the manipulator of FIG. 12*a* in a parked position.

Thus in one preferred embodiment, tong is preferably mounted on a manipulator 99 as shown in FIGS. 12*a* and 12*b*. A slewing base 100 is mounted to the drilling rig floor. A hydraulic slewing motor 101, via a gear reduction, can turn the slewing base up to three hundred and sixty degrees about the vertical axis. The internal bearings of the slewing base can support the weight and overturning moments of the manipulator structure and the tong. Slewing motor 101 may alternatively be electric, pneumatic or manually actuated.

A first boom, boom 102, is pivotally mounted to the slewing base 100. Boom 102 is rotated in a vertical plane about its base pivot by linear actuator(s) 104. Its inclination is monitored by angle sensor 107.

A second boom, boom 103, is pivotally mounted at the top of boom 102. The angle of boom 103 relative to boom 102 is controlled by linear actuator(s) 105. The inclination on boom 103 is monitored by angle sensor 108.

The tong is pivotally mounted at the end of boom 103. The angle of the tong relative to boom 103 is controlled by linear actuator(s) 106. The inclination of the tong is monitored by angle sensor 109.

The actuators 104, 105 and 106 can be single or paired and are preferably hydraulic cylinders but could be screw actuators drive by electric or hydraulic motors or any other form of linear actuators. Alternatively, rotary actuators at the pivot axes could be used.

Angle sensors 107, 108 and 109 are preferably inclination sensors rigidly mounted to the structure which measure the angular displacement from a gravitational reference. Shaft-driven angle transducers could also be used. Position feedback could also be achieved using linear displacement transducers in or adjacent to actuators 104, 105 and 106.

Various possible tong positions are selectively positioned between the extended operating position illustrated in FIG. 12*a* and the parked position of FIG. 12*b*. It can be seen that the manipulator 99 provides a large range of motion but can park the tong 6 with a small footprint.

The booms have significant lateral and torsional stiffness. This is advantageous over prior systems because the structure can react toque applied to the tong by a top drive in the rig, such as for back-up of drilling connection make-up. The tong can also apply torque to make up a bit restrained in the rig's rotary table.

Manipulator 99 may be fully functional with manual controls for each of the four output actuators (stewing motor 101 and linear actuators 104, 105 and 106). However, if preferably has a control system as described below in which horizontal and vertical rates of tong travel are controlled in direct proportion to horizontal and vertical velocity commands by the operator and the tong is automatically kept level. The control system may also include the capability of optimized travel, including acceleration and deceleration control, to pre-defined locations.

The tong's vertical and radial positions (relative to the stewing base) at any time are computed by the programmable logic control (PLC) 112 geometric constants and the boom 102 and 103 angles measured by angle sensors 107 and 108. The stewing orientation is measured preferably by an encoder 110 on the stewing drive. The tong's three-dimensional position is therefore monitored at all times.

The preferred operators control console has a single 3-axis joystick 111 for control of the manipulator. The x-axis of joystick 111 controls the horizontal motions of the tong, the y-axis of the joystick 111 controls the vertical motions of the tong and the z-axis (handle twist) of the joystick controls the stewing motions of the assembly. The joystick commands may be discrete ON/OFF but are preferably analog/proportional on the x and y axes for finer control.

Figure 13:
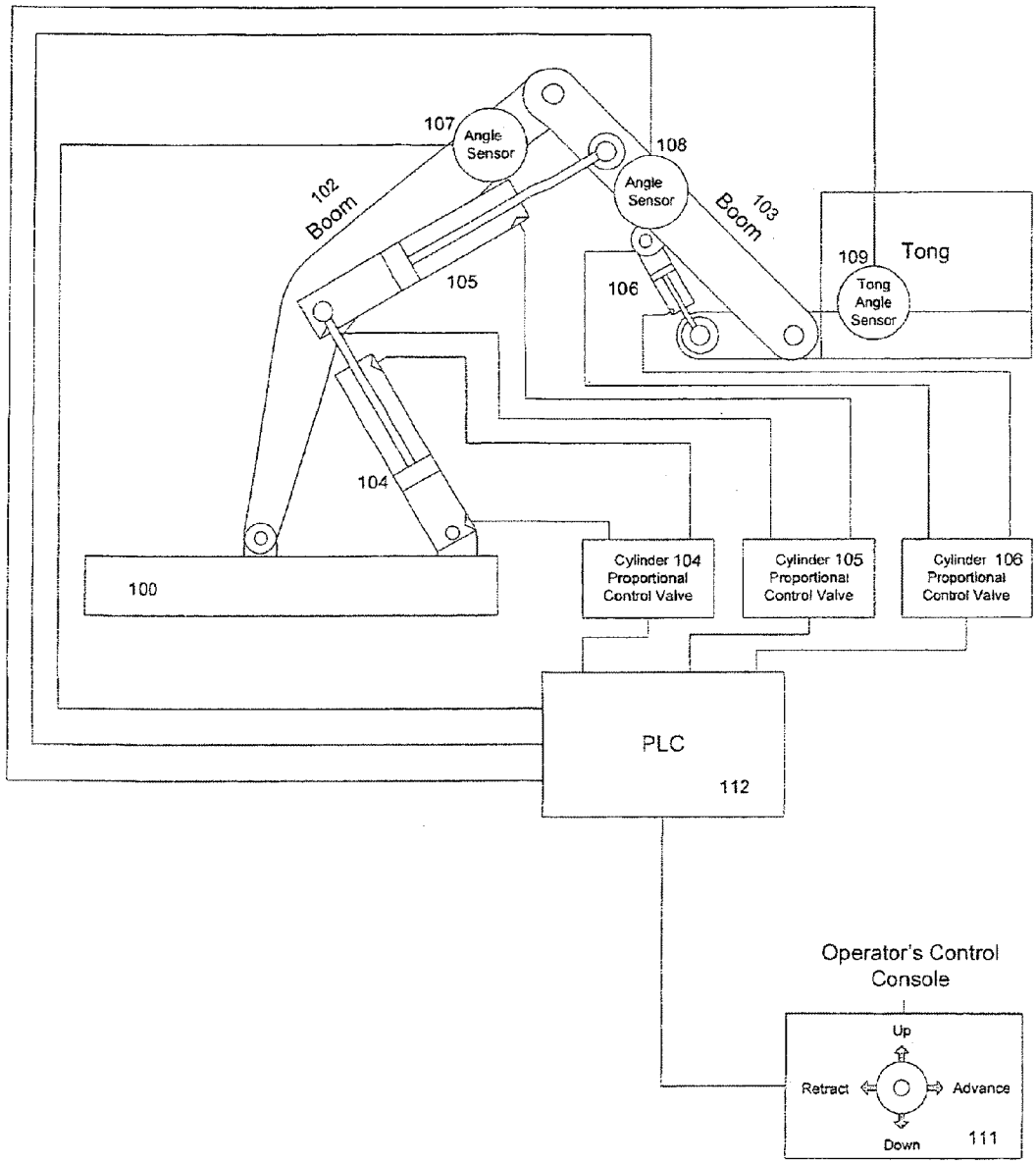
FIGS. 13 and 14 are diagrammatic flow charts of the controls of the manipulator of FIG. 12*a*.
Figure 14:
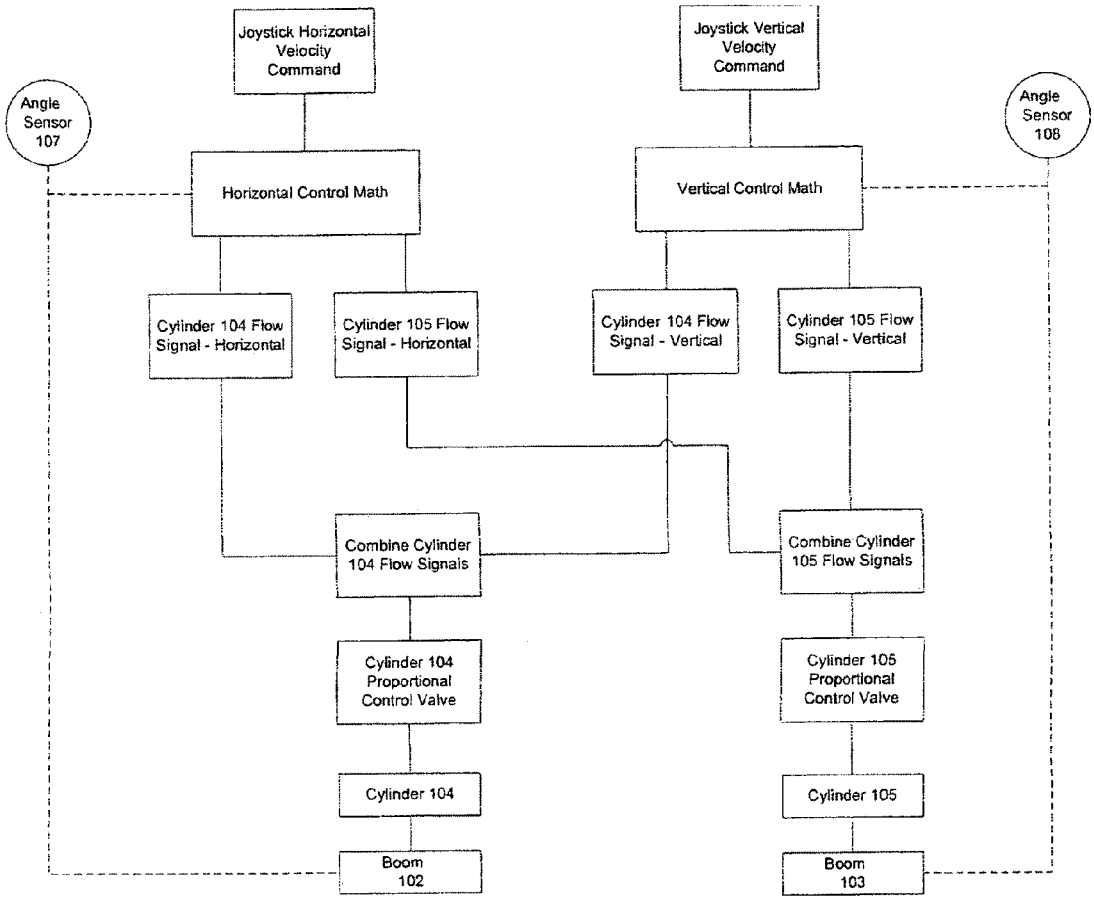

FIGS. 13 and 14 show a diagrammatic flowchart of the preferred controls for manipulator 99.

Horizontal motion of the tong requires movement of both boom 102 and boom 103, accomplished via linear actuators 104 and 105. The required output velocity signals to each of linear actuators 104 and 105 are computed in the PLC 112 in order to achieve the desired horizontal command velocity from the x-axis of joystick 111.

Similarly, vertical motion of the tong requires movement of both boom 102 and boom 103, accomplished via linear actuators 104 and 105. The required output velocity signals to each of linear actuators 104 and 105 are computed in the PLC 112 in order to achieve the desired vertical command velocity from the y-axis of joystick 111.

The control system is also capable of combined horizontal/vertical motion control. In this case the required velocity signals for linear actuators 105 and 105 are computed separately for each axis (horizontal/vertical) and then superimposed for output to the actuators.

A feedback loop may optionally be employed in which, for each motion axis (horizontal/vertical) the actual velocity (rate of change of position over time) is periodically compared to the joystick velocity command and any necessary adjustment made. This feedback is particularly useful when the operator commands pure horizontal or pure vertical motion at the joystick. If the operator commands a pure vertical motion, for example, any inadvertent deviation from the vertical axis will be detected and adjustments made to the velocity signals to linear actuators 104 and 105 to tune it back to a pure vertical motion.

Output to linear actuator(s) 106 is controlled by the PLC 112 to keep the tong level at all times according to input from angle sensor 109.

The control system may also have capability for automated travel to pre-defined locations such as well center, mousehole and parked position. When the operator commands automated travel to a desired pre-defined target location, the control system control acceleration, travel velocity, deceleration and landing speed for both horizontal and vertical axes to achieve optimum travel to the target, with minimum elapsed time and smooth, controlled motion.

It can be seen that the control system enables efficient Cartesian motion control (horizontal/vertical) of a polar (pivoting booms) mechanism, which has mechanical and operational advantages.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. An apparatus including a power tong for threading and unthreading a threaded joint in a tubular, the tong comprising:

a rotary jaw housed within a drive section, wherein said rotary jaw includes a rotary jaw having a slot, said slot having a throat at an opening thereof, a back up jaw mounted to said drive section, said backup jaw and said drive sections having aligned openings therein, said rotary jaw adapted for three hundred sixty degree rotation relative to said drive section and said backup jaw about an axis of rotation passing through centers of said drive section, said rotary jaw and said backup jaw, said slot in said rotary jaw and said opening sized for receiving a tubular into said centers of said drive section, said rotary jaw and said backup jaw, first grippers mounted at said center of said rotary jaw, and second grippers mounted at said center of said backup jaw, said first and second grippers adapted to hold a tubular on opposite sides of a threaded joint in the tubular, said drive section having a primary drive mounted thereon selectively rotating said rotary jaw relative to said drive section and said backdrop jaw about said axis of rotation, wherein said axis of rotation is substantially coaxial with the tubular when the tubular is positioned into said centers and gripped by said first and second grippers, wherein, with the tubular gripped by said grippers, and with the threaded joint of the tubular positioned between said rotary jaw and said backup jaw, said rotation of said rotary jaw about said axis of rotation and driven by said primary drive urges relative rotation between oppositely disposed ends of the tubular oppositely disposed on either side of the threaded joint, wherein a secondary drive is mounted on said drive section, and wherein gripper actuators are mounted to said rotary jaw, and wherein said gripper actuators cooperate with so as to selectively actuate said first grippers whereby said rotary jaw forms a substantially self-contained three hundred sixty degree rotatable tubular gripping system for gripping the tubular and rotation thereof about said three hundred sixty degrees of rotation relative to said drive section and said backup jaw, and wherein a nested transmission is mounted in said drive section in cooperation with said rotary jaw to provide power from said secondary drive to said gripper actuator, wherein said nested transmission includes a first set of sprockets rotatably mounted to said drive section, a flexible serpentine member mounted around said first set of sprockets so as to cooperate with and be driven by said secondary drive, and a second set of sprockets rotatably mounted to so as to cooperate with said rotary jaw wherein a flexible synchronizing member is mounted around said second set of sprockets, wherein said first and second sets of sprockets are nested relative to one another so that said second set of sprockets is nested closely adjacent within said first set of sprockets substantially concentrically around said axis of rotation, and wherein said first set of sprockets and at least one said flexible serpentine member forms at least one C section serpentine drive loop, said at least one C section serpentine drive loop positioned around, so as to not interfere with access of a tubular into, said openings in said back-up jaw and said drive section, and wherein said second set of sprockets and at least one said flexible synchronizing member forms at least one synchronization, drive loop, said at least one synchronization drive loop positioned around, so as to not interfere with, said throat and said slot in said rotary jaw, and wherein at least one of said sprockets of said second set of sprockets is in contact with, so as to be driven by, said at least one flexible serpentine member at all times as said rotary jaw is rotated relative to said drive section and said back-up jaw to thereby continuously transfer power from said drive section to said gripper actuator during when said rotary jaw is at rest and during said full three hundred sixty degrees of said rotation of said rotary jaw about said axis of rotation.

2. The apparatus of claim 1 wherein at least one pair of sprockets of said second set of sprockets are spaced apart sufficiently so as to at least span a distance substantially equal to a distance across said throat of said slot of said rotary jaw during said rotation of said rotary jaw and corresponding simultaneous rotation of said at least one pair of sprockets of said second set of sprockets, and wherein at least one pair of sprockets of said first set of sprockets are spaced apart sufficiently so as to span a distance across said openings of said drive section and said back-up jaw, and wherein during said rotation of said rotary jaw at least one of said at least one pair of sprockets of said first set of sprockets remains in driving engagement with at least one of said at least one pair of sprockets of said second set of sprockets at all times during said full three hundred and sixty degrees of rotation of said rotary jaw.

3. The apparatus of claim 2 wherein said serpentine member in said nested transmission includes a serpentine belt rotatably mounted in said drive section, and wherein said synchronizing member includes a synchronizing belt.

4. The apparatus of claim 2 wherein said at least one pair of sprockets of said second set of sprockets on said rotary jaw are spaced apart so as to only sequentially cross only one at a time across said opening of said synchronization drive loop.

5. The apparatus of claim 4 wherein said drive section and said backup jaw are mounted on a common frame in fixed relation to one another.

6. The apparatus of claim 2 wherein said secondary drive runs continuously to continuously supply motive power to said gripper actuator, independently of operation of said primary drive rotating said rotary jaw.

7. The apparatus of claim 6, wherein said gripper actuator includes a motor and a generator.

8. The apparatus of claim 7 wherein said primary drive is a hydraulic motor.

9. The apparatus of claim 7 wherein said gripper actuator includes a radially spaced apart array of selectively actuable gripping cylinders, radially spaced apart around said axis of rotation.

10. The apparatus of claim 9 wherein said array includes at least three of said gripping cylinders arranged in a substantially equally radially spaced apart array and lying in a substantially horizontal plane.

11. The apparatus of claim 10 wherein said gripping cylinders include means for centralizing the tubular in said center of said rotary jaw.

12. The apparatus of claim 11 wherein said means for centralizing the tubular includes reaction links and includes pivotally mounting radially outward ends of at least two of said cylinders in said array to allow pivoting of said cylinders in said substantially horizontal plane, and coupling radially inward ends, opposite said radially outward ends, of said cylinders to said rotary jaw by pivotally mounting said reaction links between said rotary jaw and said radially inward ends wherein said reaction links include one reaction link of said reaction links per each cylinder of said at least two of said cylinders, wherein each said reaction link is pivotally coupled at opposite ends thereof to a corresponding said radially inward end and an adjacent location on said rotary jaw respectively.

13. The apparatus of claim 12 wherein said each reaction link further comprises a first timing gear mounted thereon, and further comprises a corresponding synchronization link for said each reaction link, each said corresponding synchronization link having a second timing gear engaging a corresponding said first timing gear, whereby upon actuation of said at least two of said cylinders, clamping of the tubular is orchestrated and synchronized by cooperatively orchestrated and synchronized engagement of radially innermost ends of said cylinders with the tubular.

14. The apparatus of claim 9 wherein each said gripping cylinder is hydraulically actuated by a rotary jaw hydraulic circuit, and wherein said rotary jaw hydraulic circuit includes at least one pump cooperating with a directional control valve controlling extension and retraction strokes of said each cylinder, and wherein said rotary jaw hydraulic circuit further comprises at least one gas-charged accumulator.

15. The apparatus of claim 14 further comprising a parallel cylinder extension portion of said circuit comprising a low-pressure rapid advance first leg in parallel with a high-pressure geared leg, wherein pressurizing of said first or second legs is selectively controlled by said directional control valve, and wherein said second leg includes a pressure intensifier.

16. The apparatus of claim 15 wherein said second leg further comprises a proportional pressure control cooperating with said pressure intensifier.

17. The apparatus of claim 16 wherein said circuit actuates all of said gripping cylinders in parallel.

18. A power tong system comprising, in combination with the power tong of claim 1, a selectively actuable manipulator arm mounted thereto wherein said arm has a base end mountable to a drilling rig platform and an opposite distal end, a plurality of independently actuable sections extending therebetween.

19. The apparatus of claim 1 further comprising a non-contact caliper sensor mounted thereto and cooperating therewith for sensing across said axis of rotation, said sensor detecting a width diameter dimension of the tubular, the apparatus further comprising a processor, said sensor cooperating with said processor and transmitting width diameter dimension in formation sensed by said sensor to said processor, said processor determining variations in said dimension at positions along the tubular for prediction of a location of a joint seam in the tubular.

* * * * *